US007098615B2

(12) United States Patent
Swenson et al.

(10) Patent No.: US 7,098,615 B2
(45) Date of Patent: Aug. 29, 2006

(54) RADIO FREQUENCY FOCUSED INTERDIGITAL LINEAR ACCELERATOR

(75) Inventors: Donald A. Swenson, Albuquerque, NM (US); W. Joel Starling, Albuquerque, NM (US)

(73) Assignee: Linac Systems, LLC, Albuquerque, NM (US)

( * ) Notice: Subject to any disclaimer, the term of this patent is extended or adjusted under 35 U.S.C. 154(b) by 98 days.

(21) Appl. No.: 10/834,506

(22) Filed: Apr. 28, 2004

(65) Prior Publication Data

US 2004/0212331 A1 Oct. 28, 2004

Related U.S. Application Data

(63) Continuation-in-part of application No. 10/136,905, filed on May 2, 2002, now Pat. No. 6,777,893.

(60) Provisional application No. 60/467,478, filed on May 2, 2003.

(51) Int. Cl.
*H01J 23/08* (2006.01)
*H05H 7/00* (2006.01)

(52) U.S. Cl. ..... 315/505; 315/506

(58) Field of Classification Search ..... 315/500–507, 315/5.34, 5.35, 5.36, 5.41
See application file for complete search history.

(56) References Cited

U.S. PATENT DOCUMENTS

| | | | | |
|---|---|---|---|---|
| 3,501,734 | A | 3/1970 | Knapp et al. | 328/233 |
| 3,710,163 | A | 1/1973 | Bomko et al. | 313/63 |
| 4,006,422 | A | 2/1977 | Schriber | 328/233 |
| 4,024,426 | A | 5/1977 | Vaguine | 315/5.41 |
| 4,118,652 | A | 10/1978 | Vaguine | 315/5.41 |
| 4,122,373 | A | 10/1978 | Vaguine | 315/5.41 |
| 4,146,817 | A | 3/1979 | McEuen et al. | 315/5.41 |
| 4,162,423 | A | 7/1979 | Tran | 315/5.41 |
| 4,181,894 | A | 1/1980 | Pottier | 328/233 |
| 4,211,954 | A | 7/1980 | Swenson | 315/5.41 |
| 4,287,488 | A | 9/1981 | Brau et al. | 331/94.5 PE |
| 4,323,857 | A | 4/1982 | Brau et al. | 372/2 |
| 4,425,529 | A | 1/1984 | Leboutet | 315/5.41 |
| 4,479,218 | A | 10/1984 | Brau et al. | 372/2 |
| 4,485,346 | A | 11/1984 | Swenson et al. | 328/233 |
| 4,596,946 | A | 6/1986 | Pottier | 315/5.41 |
| 4,639,641 | A | 1/1987 | Trone | 315/5.41 |

(Continued)

OTHER PUBLICATIONS

D.H. Sloan and E.O. lawrence, "The Production of Heavy High Speed Ions Without the Use of High Voltages," Phys. Rev. 38, 2021 (1931.

(Continued)

*Primary Examiner*—Wilson Lee
(74) *Attorney, Agent, or Firm*—Andrea L. Mays; Dennis F. Armijo

(57) ABSTRACT

An interdigital (Wideröe) linear accelerator employing drift tubes, and associated support stems that couple to both the longitudinal and support stem electromagnetic fields of the linac, creating rf quadrupole fields along the axis of the linac to provide transverse focusing for the particle beam. Each drift tube comprises two separate electrodes operating at different electrical potentials as determined by cavity rf fields. Each electrode supports two fingers, pointing towards the opposite end of the drift tube, forming a four-finger geometry that produces an rf quadrupole field distribution along its axis. The fundamental periodicity of the structure is equal to one half of the particle wavelength $\beta\lambda$, where $\beta$ is the particle velocity in units of the velocity of light and $\lambda$ is the free space wavelength of the rf. Particles are accelerated in the gaps between drift tubes. The particle beam is focused in regions inside the drift tubes.

37 Claims, 15 Drawing Sheets

U.S. PATENT DOCUMENTS

| | | | | |
|---|---|---|---|---|
| 4,712,042 | A * | 12/1987 | Hamm | 315/5.41 |
| 4,715,038 | A | 12/1987 | Fraser et al. | 372/2 |
| 4,906,896 | A | 3/1990 | Swenson | 315/5.41 |
| 5,014,014 | A | 5/1991 | Swenson | 328/233 |
| 5,084,682 | A | 1/1992 | Swenson et al. | 328/233 |
| 5,113,141 | A | 5/1992 | Swenson | 328/233 |
| 5,523,659 | A * | 6/1996 | Swenson | 315/506 |
| 6,777,893 | B1 * | 8/2004 | Swenson | 315/505 |

OTHER PUBLICATIONS

L. Smith and R.L. Gluckstern, "Focusing in Linear Ion Accellerators," RSI 26, 220 (1955).

E.D. Courant and H.S. Snyder, "Theory of the Alternating-Gradient Synchrotron," Annl. Phys. 3, 1 (1958).

E.L. Hubbard, et al., "Heavy-Ion Linear Accelerator" RSI 32, 621 (1961).

R.M. Main, "Review of Linear Accelerators for Heavy Ions," 1996 Linac Conf. Los Alamos, NM, 1131 (1966).

I.M. Kapchinskii and V.A. Teplyakov, Linear Ion Accelerator with Spatially Homogeneous Strong Focusing, Prib. Tekh. Eksp., No. 2, pp. 19-22 (1970).

D. Boussard, "Radiofrequency Focusing in Heavy Ion Linear Accelerators," Linear Accelerators, North Holland Publishing Co., 1073 (1970).

M. Blann, "Heavy Ion Accelerators of the Future," Nucl. Instr. and Meth. 97,1 (1971).

D.D. Armstrong, et al., "Experimental Study of Spiral Resonators for Acceleration of Low Velocity Ions," Parcile Accelerators, 6, pp. 175 (1975).

L.M. Bollinger et al., "The Argonne Superconducting Heavy-Ion LINAC," 1976 Linac Conf., Chalk River, Ontario, 95 (1976).

D. Bobne, "The UNILAC, Development and Present Status," 1976 Linac Conf., Chalk River, Ontario, 2 (1976).

H.A. Grunder and F.B. Selph, "Heavy-Ion Accelerators," Ann. Rev. Nucl. Sci. 27, 353 (1977).

D.A. Swenson, Low-Beta Linac Structures, 1979 Linear Accelerator Conference, Montauk, NY, pp. 129 (1979).

R.H. Stokes, K.R. Crandall, J.E. Stovall, and D.A. Swenson, "RF Quadrupole Beam Dynamics," IEEE Trans. on Nucl. Sci. NS-26, 3459 (1979).

I.M. Kapchinckii, "Intense Linear Ion Accelerators," Sov. Phys. Usp. 23(12), (1980), pp. 835 (1980).

H. Klein, A. Schempp, et al., "Upgrading of the Single-Ended 7 MV Van de Graaff Accelerator in Frankfurt," Nucl. Instr. and Meth. 220, 200 (1984).

H.F. Glavish, "Radio-Frequency Linear Accelerator for Ion Implanters," Nucl. Instr. and Meth. 21, 218 (1987).

I.M. Kapchinckii, "History of RFQ Development," 1984 Linac Conf., Darmstadt, pp. 43 (1984).

V.A. Tepliakov, "RFQ Focusing in Linacs," 1992 Linear Accelerator Conference, pp. 21 (1992).

D.A. Swenson, "RF-Focused Drift-Tube Linac Structure," 1994 Linac Conf., Tsukuba, Japan, (1994).

B. Krietenstein, et al., "Numerical Simulation of IH Accelerators with MAFIA and RfModel Measurements," 1996 Linac Conf. CERN, Geneva, (1996).

D.A. Swenson, F.W. Guy, K.R. Crandall, "Merits of the RFD Linac Structure for Proton and Light-Ion Acceleration Systems," 1996 EPAC Conf., Sitges, Spain (1996).

D.A. Swenson, "Compact, Inexpensive, Epithermal Neutron Source for BNCT," (CAAR 1998, Denton, Texas, (1998).

D.A. Swenson, "Applications for the RFD Linac Structure," CAARI2000, Denton, Texas (2000).

* cited by examiner

RADIO FREQUENCY FOCUSED INTERDIGITAL LINEAR ACCELERATOR

CROSS-REFERENCE TO RELATED APPLICATIONS

This application is a continuation-in-part of U.S. patent application Ser. No. 10/136,905, entitled "Radio Frequency Focused Interdigital Linear Accelerator," filed on May 2, 2002, now U.S. Pat. No. 6,777,893, and claims the benefit of the filing date thereof. The entire specification of the parent application is incorporated herein by reference.

This application claims priority to U.S. Provisional Patent Application Ser. No. 60/467,478, entitled "Radio Frequency Focused Stacked Cell Interdigital Linear Accelerator," filed on May 2, 2003, and claims the benefit of the filing date thereof. The entire specification of the provisional application is incorporated herein by reference.

GOVERNMENT RIGHTS CLAUSE

The U.S. Government has a paid-up license in this invention and the right in limited circumstances to require the patent owner to license others on reasonable terms as provided for by the terms of SBIR Grant No. DE-FG02-03ER83835 awarded by the Department of Energy.

BACKGROUND OF THE INVENTION

1. Field

The present invention relates to an apparatus for acceleration of a beam of charged particles along a linear trajectory in a linear accelerator (linac). More particularly, the present invention is related to an Interdigital (or Wideröe) linac consisting of a linear array of electrodes, or drift tubes, that can be excited with radio frequency (rf) power to produce electric fields in the gaps between the electrodes that alternate in direction from adjacent gaps in a manner suitable for acceleration of protons, deuterons, and heavier ions.

2. Background

Particle accelerators are machines built for the purpose of accelerating electrically charged particles to kinetic energies sufficiently high to produce certain desired nuclear reactions, ionization phenomenon, and/or materials modification processes. Typically, charged particles from an ion source are collimated into a "beam" and injected into accelerating structures, where they follow certain trajectories under the influence of bending, steering, focusing and accelerating fields until they have reached the required energy. At this point, the beam is typically extracted from the accelerator system and directed onto a "target", where the desired reactions occur. The by-products of these reactions can be used for scientific, medical, industrial and military applications.

Linear accelerators (linacs) represent one of the main technologies for the acceleration of charged particles (atomic ions) from their sources (ion sources) to the desired particle energy, or to particle energies where other types of accelerators, such as synchrotrons (circular accelerators), are preferred. For protons, this often encompasses the energy range from 30 kilo-electron-volts (keV) to hundreds of million-electron-volts (MeV), or a velocity range from about 0.008 to about 0.8 times the velocity of light.

Linacs generally involve evacuated, metallic cavities or transmission lines, filled with radio-frequency electromagnetic energy waves that result in strong alternating electric fields that can accelerate charged particles. Linac art is categorized by the properties of the rf waves, yielding two types of linacs, namely standing wave linacs and traveling wave linacs.

Alternatively, linacs may be classified according to the particle velocities that they accommodate. Generally speaking, standing wave linacs are used for particle velocities less than half the velocity of light (low beta linacs). Both standing wave and traveling wave linacs are used for higher velocities (high beta linacs). At velocities close to that of the velocity of light, traveling wave linacs predominate.

Common standing wave linac structures include the radio frequency quadrupole (RFQ) linac structure, which has become common in the lowest-velocity end of linacs, the interdigital, or Wideröe linac, which is sometimes used for acceleration of low-energy heavy ions, the drift tube linac (DTL) structure, commonly used for middle-velocity linacs, and the coupled cavity linac (CCL) structure, typical of high-velocity standing wave linacs.

Linacs accelerate charged particles along nominally straight trajectories by means of alternating electric fields in gaps between linear arrays of electrodes located inside evacuated cavities. The alternating electric fields in these evacuated metallic cavities or transmission lines result from the excitation of electromagnetic cavity modes with radio frequency electromagnetic energy. The electrode spacing is arranged such that particles arrive at each gap between electrodes in an appropriate phase of the electric field to result in acceleration at each gap.

The capabilities of conventional linacs for accelerating high beam currents at low energies are severely limited by the available strengths of the conventional magnetic focusing elements, used to keep the beam diameters small enough to enable efficient interactions with the rf electric accelerating fields. In the development of linac technology, there have been numerous attempts to utilize electric fields for the focusing forces, which, unlike magnetic fields, are independent of particle velocity and promise superior performance at lower particle velocities. Both static electric quadrupole fields and time-dependent (rf) electric quadrupole fields have been considered for this role.

In the early 1970's the revolutionary idea of "spatially uniform strong focusing" was introduced, which offers the capability of simultaneously focusing, bunching and accelerating intense beams of charged particles with rf electric fields in one compact structure. This subsequently became known as the radio frequency quadrupole (RFQ) linac structure. RFQ linacs represent the best transformation between the continuous beams that come from ion sources and the bunched beams required by most linear accelerators. Their forces, being electric, are independent of particle velocity, allowing them to focus and bunch beams at much lower energies than possible for their magnetically focused counterparts. Their capture efficiency can approach 100% with minimal emittance growth. RFQ linacs have made a major impact on the design and performance of proton, deuteron, light-ion, and heavy-ion accelerator facilities. They have set new performance standards for accelerators and in so doing have earned a role in most future proton and other ion accelerators.

However, RFQ linacs are not without limitations. In all RFQ linac structures, the acceleration rate is inversely proportional to the particle velocity. Therefore, at some point in the process of particle acceleration, the acceleration rate drops to the point where some change in the acceleration process is desired. Unfortunately, in the conventional RFQ structure, there are no changes that can be made to the basic structure to rectify the inherent deterioration of the acceleration rate that occurs with higher velocities. As a result, for all but the lowest energy applications, an RFQ linac must be followed by a different accelerating structure, such as a magnetically focused drift tube linac (DTL), which offers higher acceleration rates in the energy range just beyond the practical limits of the RFQ structure up to velocities as high as half the speed of light. However, the magnetic focusing at the low-energy end is generally weaker than the electric focusing utilized in the RFQ structure. Consequently, matching the beam from an electrically focused RFQ linac into a magnetically focused DTL linac—often requiring several additional focusing and bunching elements as well as beam diagnostics equipment to manage the transition—tends to be too complex and expensive for most commercial applications.

U.S. Pat. No. 5,113,141, entitled "Four-Fingers RFQ Linac Structure", to Swenson, also the inventor of the subject technology herein, introduced an improved RFQ linac structure to extend the useful energy range of the conventional RFQ linac structure. The invention introduced a new degree of freedom into the system by configuring the structure as individual, four-finger-loaded acceleration/focusing cells, the orientation of which would be chosen to optimize performance. This new degree of freedom made the acceleration periodicity independent of the focusing periodicity, thus allowing the operating frequency to be raised as needed to enhance the acceleration rate without jeopardizing the required focusing action.

U.S. Pat. No. 5,523,659, entitled "Radio Frequency Focused Drift Tube Linear Accelerator", also to Swenson, introduced a new linac structure that combined the superior focal properties of the RFQ with the superior acceleration properties of the DTL linac. This structure provided strong rf focusing and efficient rf acceleration for particles at velocities beyond that which is practical for the RFQ structure. It provided a way to incorporate rf focusing into the drift tubes of a drift tube linear accelerator excited in the $TM_{010}$ rf cavity mode. This rf focused drift tube (RFD) linac structure offered the advantages of lowering the maximum energy of the RFQ to the range where it was more efficient, and extending the energy range of the combination far beyond the capabilities of the RFQ linac. The RFD linac structure, combined with a short RFQ section, offered efficient acceleration of light-ions, such as protons and deuterons, to output energies from a few MeV to 100 MeV, at radio frequencies of 200 MHz and above.

Most heavy-ion linacs, however, operate in the frequency range of 20–50 MHz. In this frequency range, DTL structures, including the RFD linac structure, become very large in diameter; for example 10 meters in diameter for a frequency of 20 MHz. For this reason, most heavy-ion linacs begin with some form of interdigital linac structure, which is modest in size—less than 1 meter in diameter—at those frequencies. As used herein, "heavy ion" refers to all ions that are heavier than the lightest ion, namely the proton. Examples of heavy ions include deuterons and ions of boron, lithium, carbon, etc. as will be understood by those skilled in the art.

It would be desirable for a linac structure to extend the remarkable rf electric quadrupole focusing properties of the RFQ linac to some form of interdigital linac, suitable for use at the lower frequencies typically used for heavy-ion acceleration.

The present invention for an rf focused interdigital linac, or "RFI linac", provides a way to incorporate rf focusing into the drift tubes of an interdigital linear accelerator excited in a $TE_{110}$-like rf cavity mode. The resulting structures are more compact and energy efficient than structures based on the $TM_{010}$ rf cavity mode. The RFI linac extends the performance of the RFQ, or other, linac structures by accelerating the small diameter, tightly bunched beams that come from RFQ, or other, linacs to higher energies.

The terms $TM_{010}$, $TM_{010}$-like, $TE_{110}$, and $TE_{110}$-like describe rf electric and magnetic field configurations in cylindrical cavities and are well known and understood by those skilled in the art. The terms $TM_{010}$ and $TE_{110}$ are well defined for empty cylindrical cavities, where the $TM_{010}$ mode is the lowest frequency rf cavity mode having a transverse magnetic field, and the $TE_{110}$ mode is the lowest frequency rf cavity mode having a transverse electric field. The introduction of additional structure within these cylindrical cavities—in this case, the drift tubes and their supports, which are essential to the acceleration process—perturbs the pure cylindrical cavity modes, resulting in what those skilled in the art refer to as $TM_{010}$-like and $TE_{110}$-like rf cavity modes.

SUMMARY

The present invention linac is an electrode and support configuration deployed as a drift tube in an interdigital linac. The drift tube extracts energy from the interdigital linac rf fields and creates an rf quadrupole field inside the electrode configuration. The rf quadrupole field focuses and defocuses a charged particle beam traveling through the linac. The resulting linac is an rf focused interdigital (RFI) linac. More than one RFI linac can be combined to form a multiple-tank RFI linac, which in turn can be combined with other types of linacs such as DTL, CCL, RFQ, or RFD linacs, to accomplish a particular result.

The present invention is further a method of focusing a charged particle beam in an interdigital linac, where rf quadrupole fields are used to focus the beam. A charged particle beam is fired into an interdigital linac, and electrode and support configurations extract energy from the interdigital linac rf fields creating rf quadrupole fields. The rf quadrupole fields focus the beam in a first plane and defocus the beam in a second plane. In order to realize a net focusing in both transverse planes, it is necessary to alternate the orientation of the four-finger geometries in the RFI drift tubes so as to produce a periodic succession of focusing and defocusing actions in each plane, which under proper conditions will result in net focusing of the particle beam in each transverse plane. The focusing periodicity will be an integer multiple of the particle wavelength.

A primary object of the RFI linac is to combine the interdigital, or Wideröe, linear accelerator, used for many low-frequency, heavy-ion applications, with rf focusing, similar to that employed in the RFD linac structure, incorporated into each drift tube.

Another primary object of the RFI linac is to provide compact, efficient, commercially-viable linear particle accelerators to accelerate protons, light ions, and heavier ions in the velocity range from about 0.05 to 0.50 times the velocity of light.

Yet another primary object of the RFI linac is to combine the strong rf focusing of the RFQ linac with the efficient acceleration of the interdigital linac such that ion energies in the range from 1 MeV to 150 MeV can be achieved at a relatively low cost.

A primary advantage of the RFI linac is the efficient acceleration and rf quadrupole focusing achieved for charged particles traveling at velocities beyond that normally considered practical for conventional RFQ linacs.

Another advantage of the RFI linac is that in many applications, the RFI linac will result in smaller and more efficient linac structures than either the RFQ or RFD linac structure.

Still another advantage of the RFI linac is that it is particularly useful for smaller, commercially-viable ion linac systems.

Still yet another advantage of the RFI linac is that its size, cost, efficiency, and performance are ideal for a number of scientific, medical, industrial, and defense applications.

Other objects, advantages and novel features, and further scope of applicability of the RFI linac will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate an embodiment of the RFI linac and, together with the description, serve to explain the principles of the invention. The drawings are only for the purpose of illustrating an embodiment of the RFI linac and are not to be construed as limiting the invention. In the drawings.

DESCRIPTION

The RFI linac comprises a configuration of electrodes, resembling an interdigital, or Wideröe, linac offering efficient acceleration and rf quadrupole focusing for charged particles traveling at velocities beyond that normally considered practical for conventional RFQ linacs. The RFI linac is an rf focused linac structure, based on the interdigital linac structure, which operates in the $TE_{110}$-like rf cavity mode. Due to differences in the rf field configurations, the scheme for incorporating rf focusing into the interdigital linac structure is quite different from that adopted for the RFD linac structure, based on the conventional drift tube, or Alvarez, linac structure, which operates in the $TM_{010}$-like rf cavity mode.

The drift tubes of the interdigital linac structure alternate in potential along the axis of the linac. Consequently, the electric field between the drift tubes alternate in direction along the axis of the linac. The longitudinal dimensions of the structure are such that the particles travel from the center of one gap to the center of the next gap in one-half of an rf cycle. Hence, particles that are accelerated in one gap will be accelerated in the next gap because, by the time the particles arrive in the next gap, the fields have changed from decelerating fields to accelerating fields.

It will be understood that the embodiment of the RFI linac described herein has application to a variety of configurations of interdigital linacs having a wide range of physical parameters. The two-part drift tubes and corresponding support stems can be configured for a variety of interdigital linacs to add rf focusing to the structure.

Figure 1:
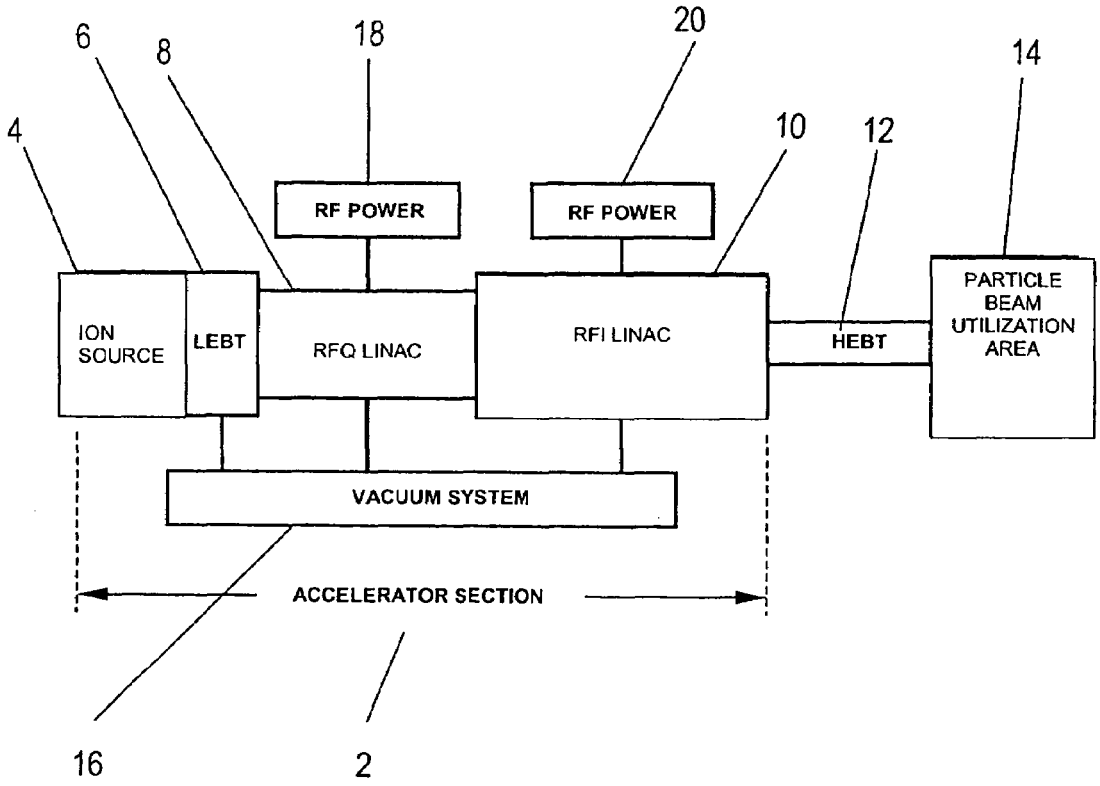
FIG. 1 is a block diagram of a complete particle accelerator system using the RFI linac.

Referring to FIG. 1, the RFI linac structure 10 is shown as part of a complete particle accelerator system, the accelerator section being shown at 2. Ion source 4 fires a collimated beam of charged particles into low energy beam transport system (LEBT) 6, which focuses and steers the charged particle beam into conventional RFQ linac 8. RFQ linac 8 uses rf electric fields to focus, bunch and accelerate the charged particles to a higher energy. The resulting small diameter, tightly bunched beam from RFQ linac 8 is injected into RFI linac 10. RFI linac 10, with its rf electric focusing and acceleration fields maintains the small beam diameter and tight bunching of the beam while accelerating the particle beam to the final energy. The particle beam is then fired into a high energy beam transport system (HEBT) 12, which focuses and steers the beam at high energy into the particle beam utilization area 14, where the particle beam may be used for scientific, medical, industrial, military and/or commercial applications.

Linac structures 8 and 10 are evacuated by vacuum pumps of the linac vacuum system 16. Ion source 4, beam transport systems 6 and 12, and particle beam utilization area 14 also have vacuum pumping systems (not shown). Linac structures 8 and 10 are powered by linac rf power systems 18 and 20.

While FIG. 1 shows one RFI linac in operation with an RFQ linac, it will be understood that more than one RFI linac can be combined to form a multiple-tank RFI linac, which in turn can be combined with other types of linacs such as the RFQ, DTL, RFD, or CCL linacs. When combined as such, each of the linacs is operated at a frequency of M*F, where M is an integer and F is a selected frequency. A control is used in the multiple-tank linac for controlling the relative phase of the accelerating fields of each linac such that incoming particle bunches arrive at the center of each drift tube gap at the proper phase for acceleration.

Figure 2:
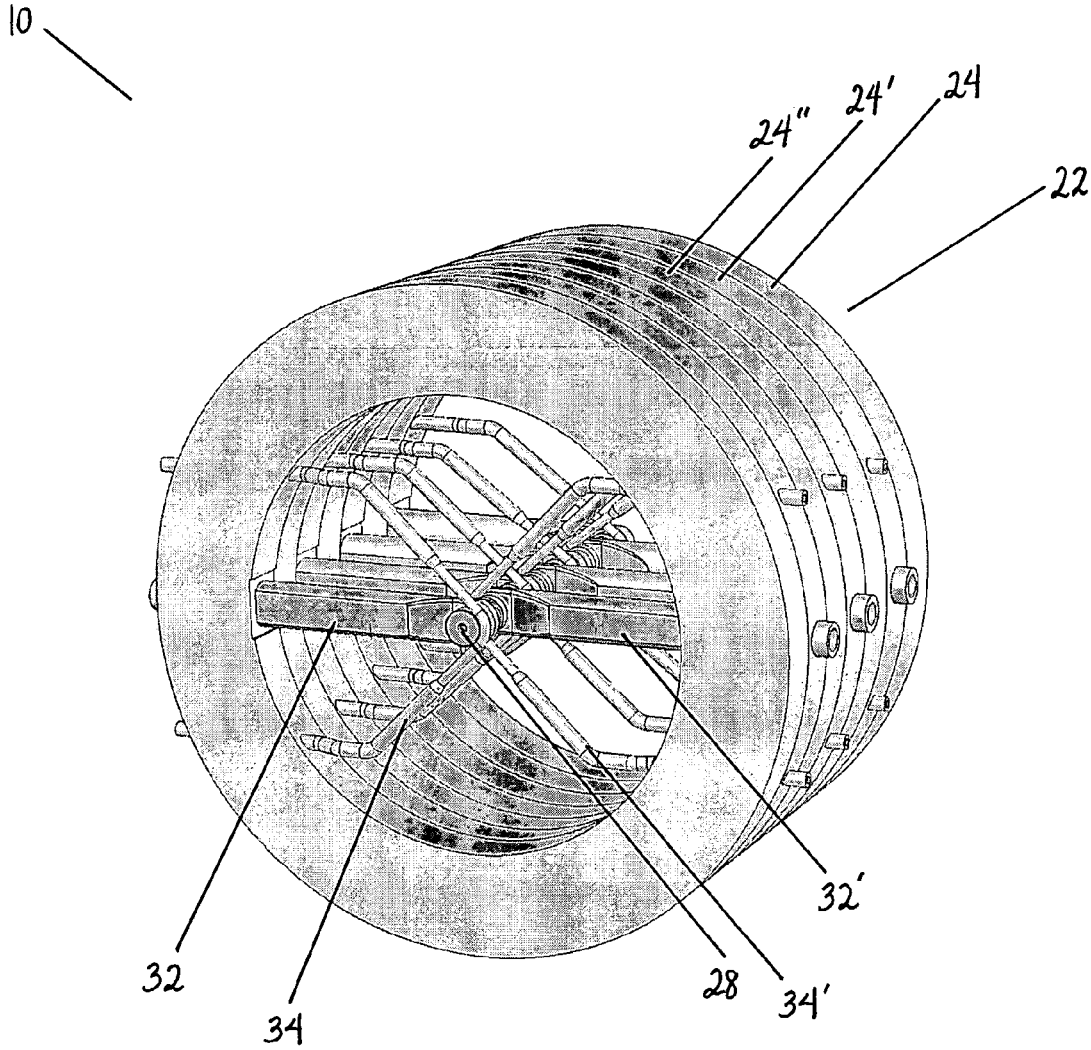
FIG. 2 is a perspective view of a section of the RFI linac with the end plates removed to expose the internal structure of the RFI linac.

FIG. 2 shows a perspective view of an embodiment of a section of the RFI linac structure 10, without the end plates for ease of viewing the internal cavity of RFI linac 10. Cylindrical tank 22 represents the principal structural element of the RFI linac structure 10 and provides ample mechanical rigidity for fastening the RFI drift tube support configurations, or "stems", 32 and 34 rigidly to the outer wall of the tank 22. Tank 22, in this embodiment, is built up of a series of thick walled aluminum rings 24, or "stacked cells", each supporting one two-part drift tube 28 and associated support stems 32 and 34. Alternately, the tank 22 can be configured as a thick-walled metal tube supporting a plurality of drift tubes 28 and drift tube support stems 32 and 34.

Water cooling channels are machined directly into the wall of linac tank 22. Opposing ends of linac tank 22 are terminated at a particular length with re-entrant end plates (not shown) to accommodate the reversal of the longitudinal magnetic field component. Vacuum seals between tank 22 and the end plates can be provided by elastomer o-rings, while the rf electrical connections can be provided by a custom flexed fin of copper-plated aluminum, machined directly into the end plates. Linac tank 22 is preferably heat treated for improved structural stability. Both tank 22 and the end plates are preferably copper-plated on the inner surfaces and painted on the outer surfaces. The copper-plated inner surface of tank 22 is a good electrical conductor and forms a resonant cavity that can be filled with electromagnetic energy. Radio frequency energy is coupled into tank 22 to excite the TE, lo rf cavity mode.

Seven drift tubes 28 and corresponding stem support configurations 32 and 34 are shown in FIG. 2, although the actual number of drift tubes varies according to the particular application, and the invention is not limited to any particular number of drift tubes. The drift tube support stems 32 and 34 are fixed rigidly to the outer wall of the linac tank 22.

Figure 3:
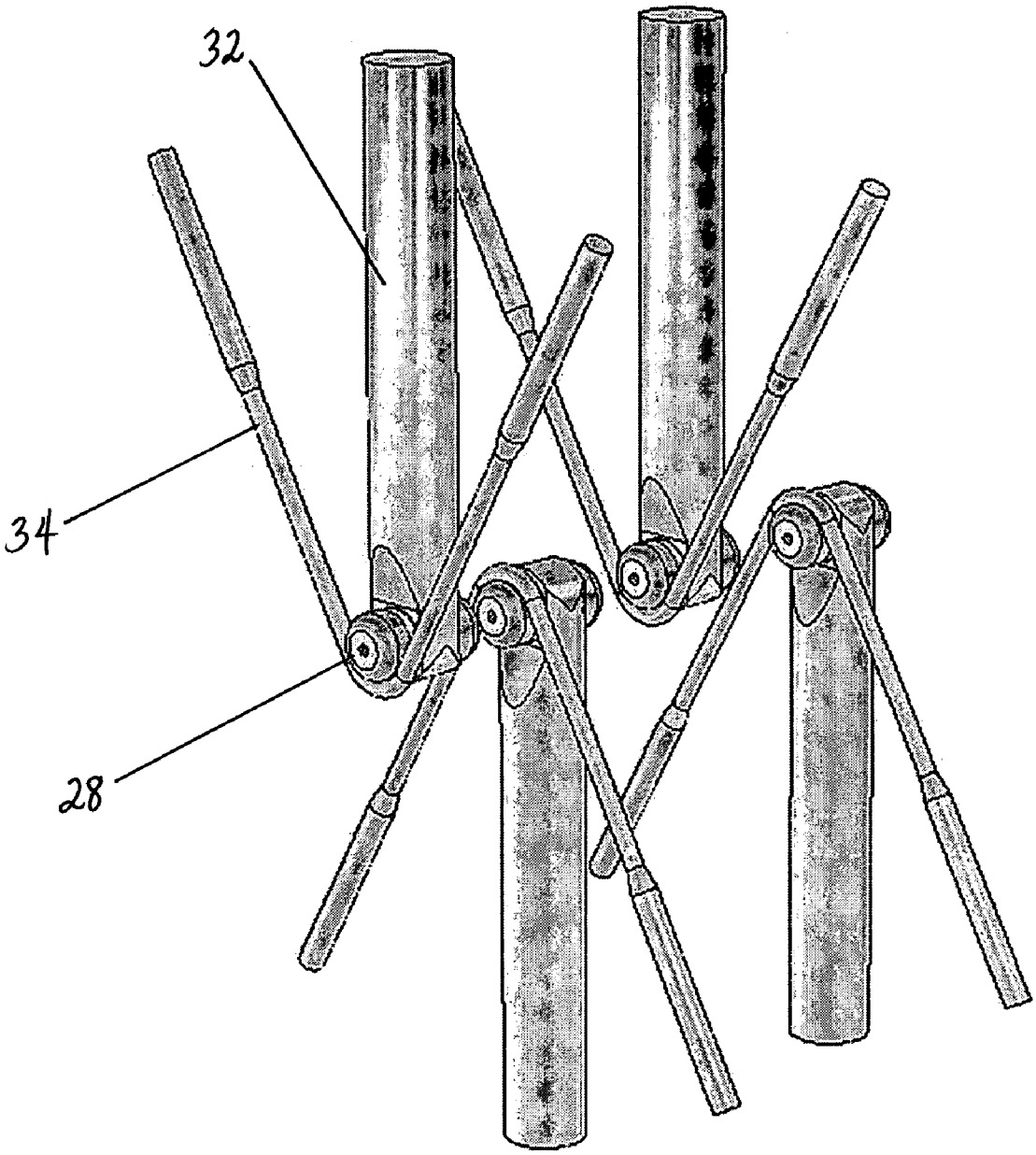
FIG. 3 is a perspective view of the drift tubes and the support stems of the RFI linac shown in FIG. 2.

Referring to FIG. 3, a perspective view of four drift tubes 28 of the RFI linac structure 10 are shown revealing the shape and position of one possible configuration for the major drift tube support stems 32 and minor drift tube support stems 34. FIG. 3 also reveals the approximate positioning of each drift tube 28 from one to the next as the beam travels along the axis of the RFI linac 10. The amount of space between each successive drift tube 28 is increased along the axis of the RFI linac 10 in order to account for the acceleration of the charged particles as they travel through the RFI linac 10.

Figure 4A:
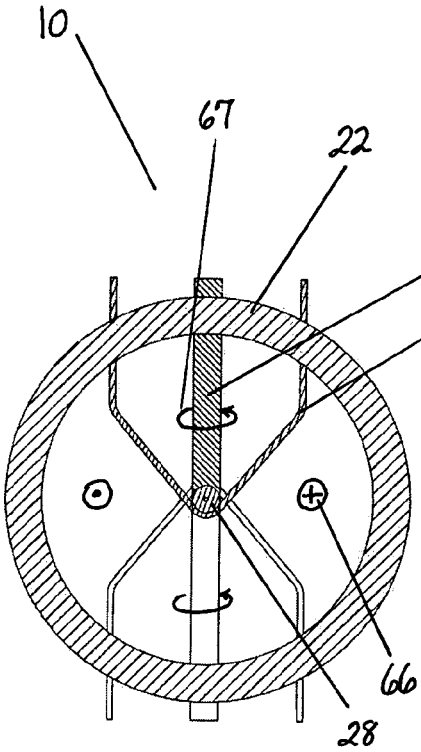
FIG. 4A is a cross-sectional end view of the RFI linac of FIG. 2.
Figure 4B:
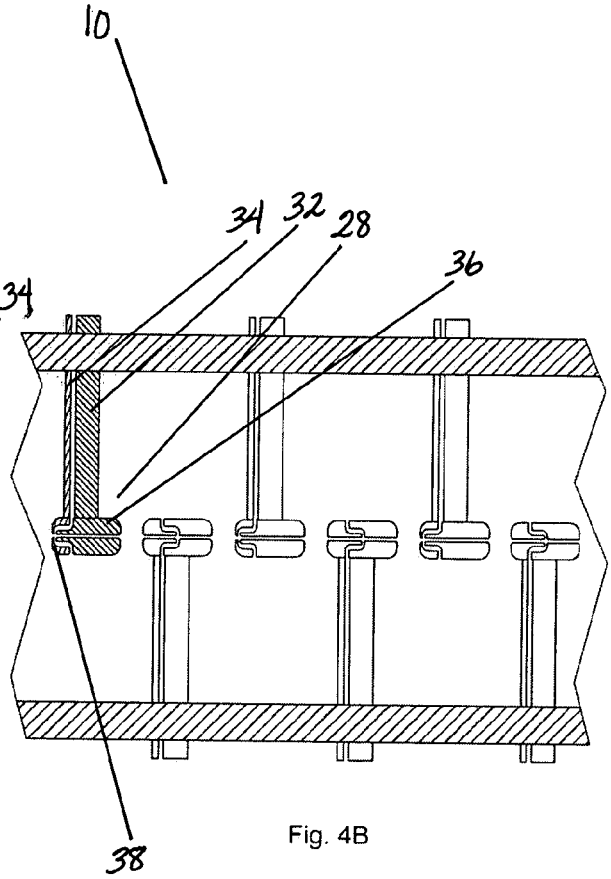
FIG. 4B is a cross-sectional side view of the RFI linac of FIG. 2.

Referring to FIGS. 4A and 4B, a cross-sectional end view and side view of the RFI linac 10 are shown. RFI linac 10 is loaded with a series of drift tubes 28 distributed along the axis of tank 22 in the manner depicted in FIG. 3 (not shown to scale in FIG. 4). Each drift tube 28 comprises two separate electrodes, a major electrode 36 and a minor electrode 38. Each two-part drift tube 28 is supported from the tank wall on two stems 32 and 34. Adjacent drift tubes are supported from the opposite side of tank 22, giving rise to the alternating pattern of drift tube supports as clearly shown in FIGS. 3 and 4B. The two-part drift tubes 28 and their supports 32 and 34 couple to the primary electromagnetic fields of the linac cavity to produce an rf electric quadrupole field inside the drift tubes 28 along the axis of the RFI linac 10 to focus the charged particle beam.

Drift tube electrodes 36 and 38 and their support stems 32 and 34 are either fabricated of copper or are copper plated to provide high electrical conductivity to reduce the electrical heating associated with the rf electromagnetic fields within the RFI linac 10. Drift tubes 28 and support stems 32 and 34 are cooled by a liquid coolant that is introduced through the outer extremities of the support stems and circulated through the stems to remove the heat dissipated on the drift tubes 28 and stems 32 and 34 by the rf electromagnetic fields.

Each electrode, 36 and 38, supports two fingers pointing inward towards the opposite electrode of the drift tube 28, forming a four fingered geometry that produces an rf quadrupole field distribution along the drift tube axis for focusing the charged particle beam. FIG. 5 provides perspective views of a drift tube 28 demonstrating the orientation of asymmetrical electrodes 36 and 38 and their corresponding fingers.

Figure 5A:
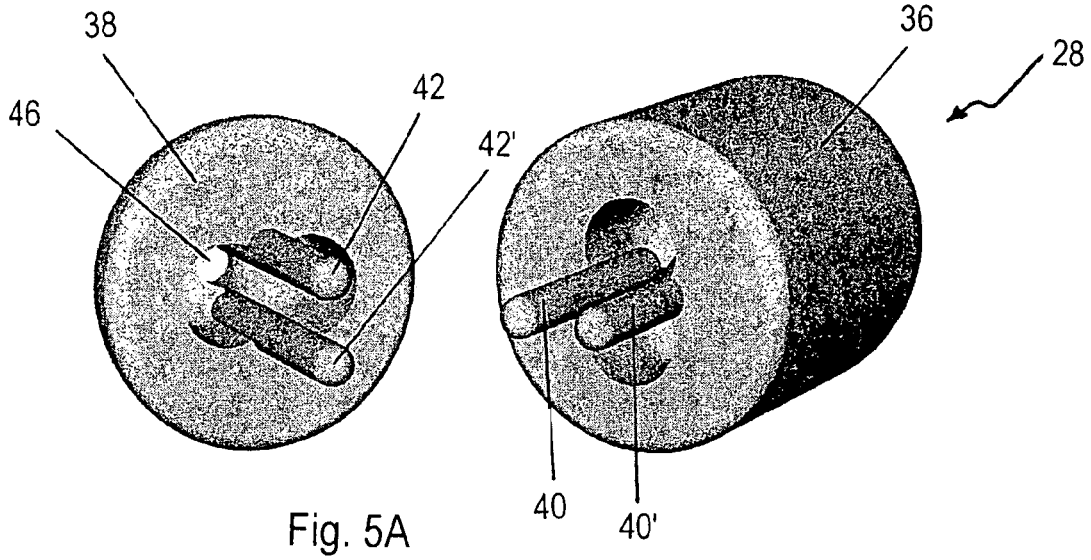
FIG. 5A is an exploded perspective view of the two-part RFI drift tube, showing the major and minor electrodes and the corresponding fingers of each electrode.

FIG. 5A is an exploded perspective view of drift tube 28 comprised of major electrode 36 and minor electrode 38, where major electrode 36 and minor electrode 38 are rotated such that the corresponding fingers can be viewed. The charged particle beam travels along the axis of RFI linac 10 through aperture 46, seen in FIG. 5A on minor electrode 38, as well as through a corresponding aperture, not shown, in major electrode 36. Major electrode 36 supports fingers 40 and minor electrode 38 supports fingers 42.

Figure 5B:
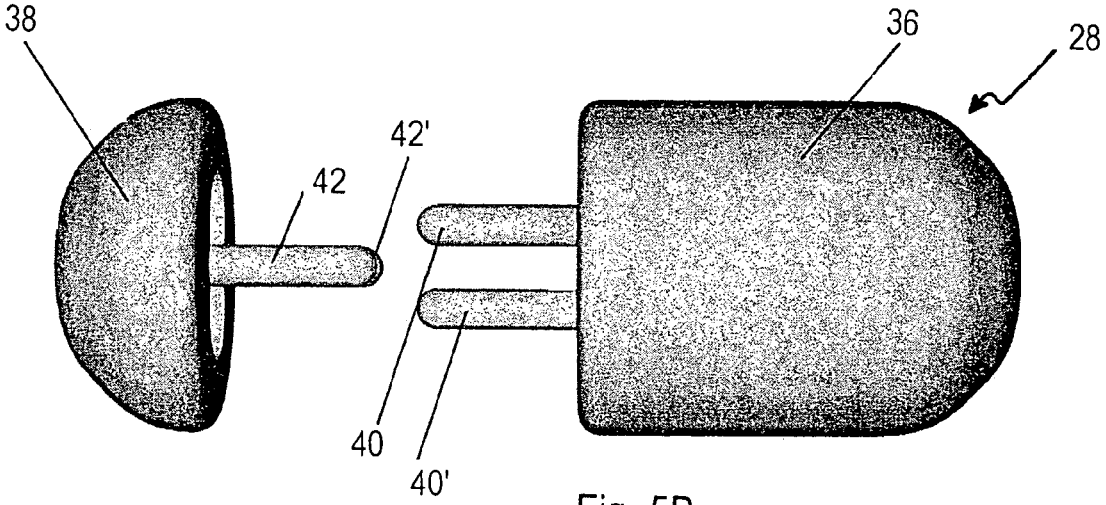
FIG. 5B is an exploded perspective view of the two-part RFI drift tube of FIG. 5A showing the relative orientation between the major and minor electrodes and corresponding fingers.
Figure 5C:
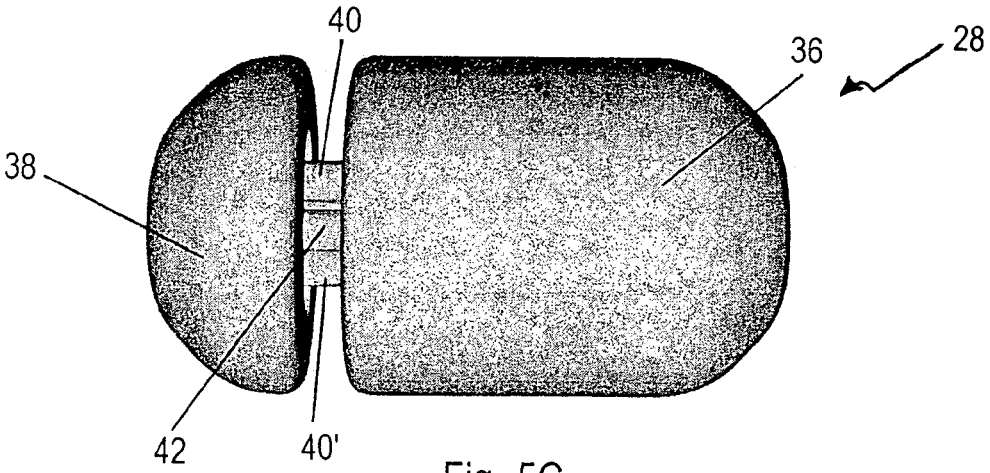
FIG. 5C is a perspective view of the two-part RFI drift tube, assembled in accordance with the present invention.

Referring to FIG. 5B, an exploded perspective view of drift tube 28, reveals how major and minor electrodes 36 and 38 and corresponding fingers 40 and 42 are oriented to one another. Major electrode 36 is approximately two times the physical size of minor electrode 38 to account for the 60° shift from the accelerating phase to the focusing phase and the 120° shift from the focusing phase to the accelerating phase. Fingers 42 of minor electrode 38 are oriented orthogonal to and between fingers 40 of major electrode 36. Referring to FIG. 5C, major and minor electrodes 36 and 38 are shown assembled to form drift tube 28, where fingers 40 and 42 (oriented as shown in FIG. 5B) in combination form an rf quadrupole field pattern for focusing the charged particle beam.

Although one design for the drift tubes of the RFI linac structure 10 is presented in FIG. 5, other mechanical designs, incorporating a minor electrode supporting two fingers and a major electrode supporting two more fingers, are possible as would be understood by those skilled in the art.

Figure 6:
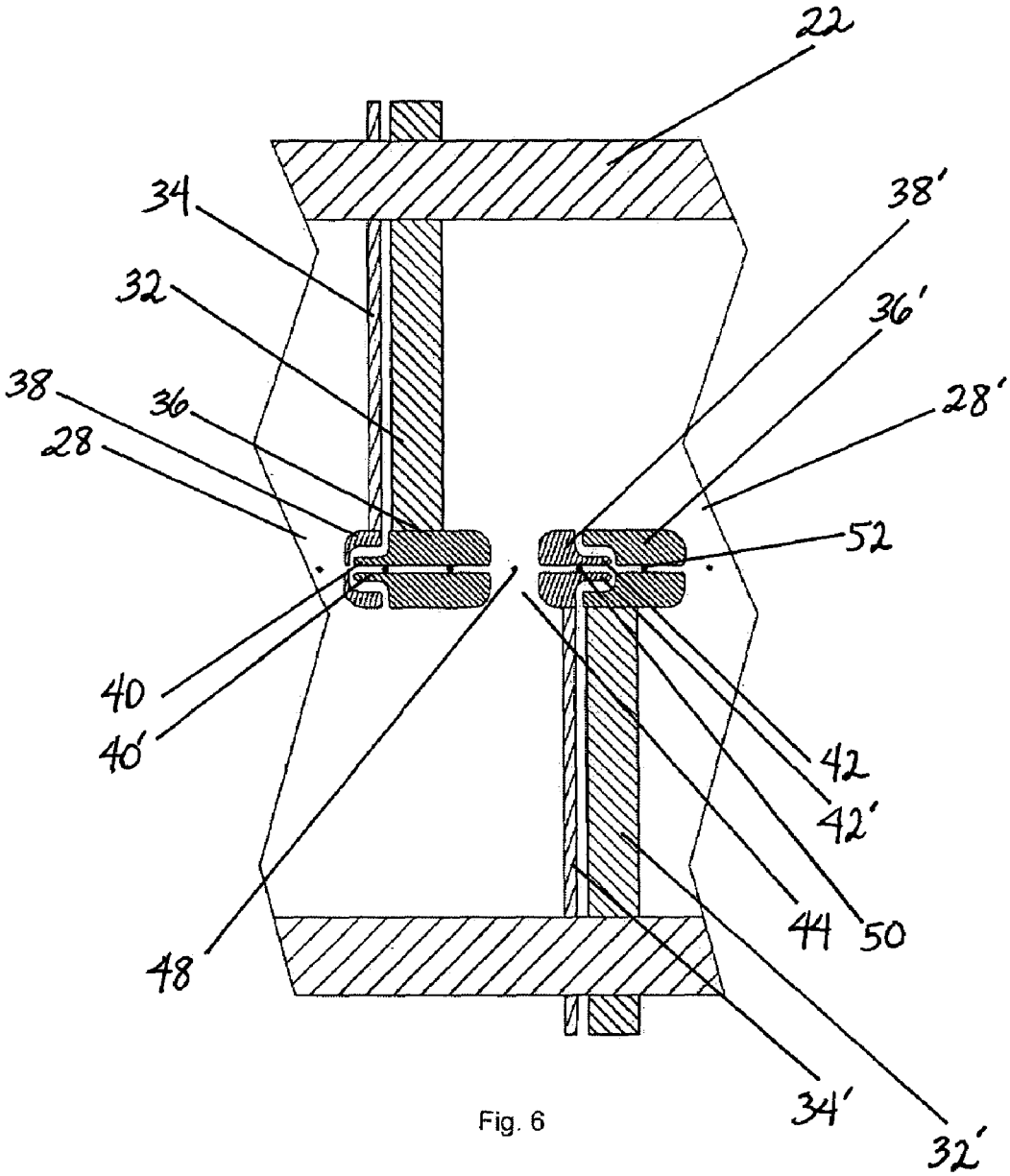
FIG. 6 is a cross-sectional side view of two two-part RFI drift tubes and associated support stems showing the location of a beam bunch at seven different times within the acceleration, focusing, and drifting actions of the RFI linac structure.

The RFI linac 10 operates on longitudinally bunched particle beams. FIG. 6 is a cross-sectional view of two drift tubes 28 and 28' showing the particle beam bunch at different rf phases. Drift tubes of the RFI linac 10 divide the linac into two distinct regions, those regions between drift tubes, referred to as acceleration gaps 44, where acceleration occurs, and the regions inside drift tubes 28, where focusing occurs. When the particle beam bunch is at the location designated 48, the beam bunch is in the acceleration region (−30°). At the location designated 50, the beam bunch is in the focusing region (+30°), and at the location designated 52 the beam bunch is in the drift region (+90°).

Two fingers 40 and 40' of major electrode 36 of drift tube 28 can be seen in the cross-sectional view of FIG. 6, while fingers 42 and 42' of minor electrode 38 of drift tube 28 cannot be seen, as those fingers are located in a plane perpendicular to the plane of the figure. Alternatively, two fingers 42 and 42' of minor electrode 38' of drift tube 28' can be seen in the cross-sectional view of FIG. 6, while fingers 40 and 40' of major electrode 36' of drift tube 28' cannot be seen, as those fingers are located in a plane perpendicular to the plane of the figure.

The longitudinal distribution of the acceleration, focusing, and drifting actions are quite different between the RFI and RFD linac structures. When the accelerated particles are half-way between the accelerating actions of the RFD linac structure, i.e. within the drift tube, the electric fields are near maximum strength in the opposite direction and are suitable for focusing the beam. In the RFI linac structure, when the accelerated particles are two-thirds of the way between the centers of the gaps, the electric fields are passing through zero strength as they change sign and are not suitable for focusing the beam. To accommodate this, the rf focusing action is pushed forward ("upstream") in the RFI linac to lie as close to the accelerating gap 44 as possible, leaving the latter portion of the drift tube as a drift space, with no focusing or accelerating action. This results in asymmetrical drift tubes, each having a minor electrode 38 upstream followed by a major electrode 36 downstream.

Figure 7:
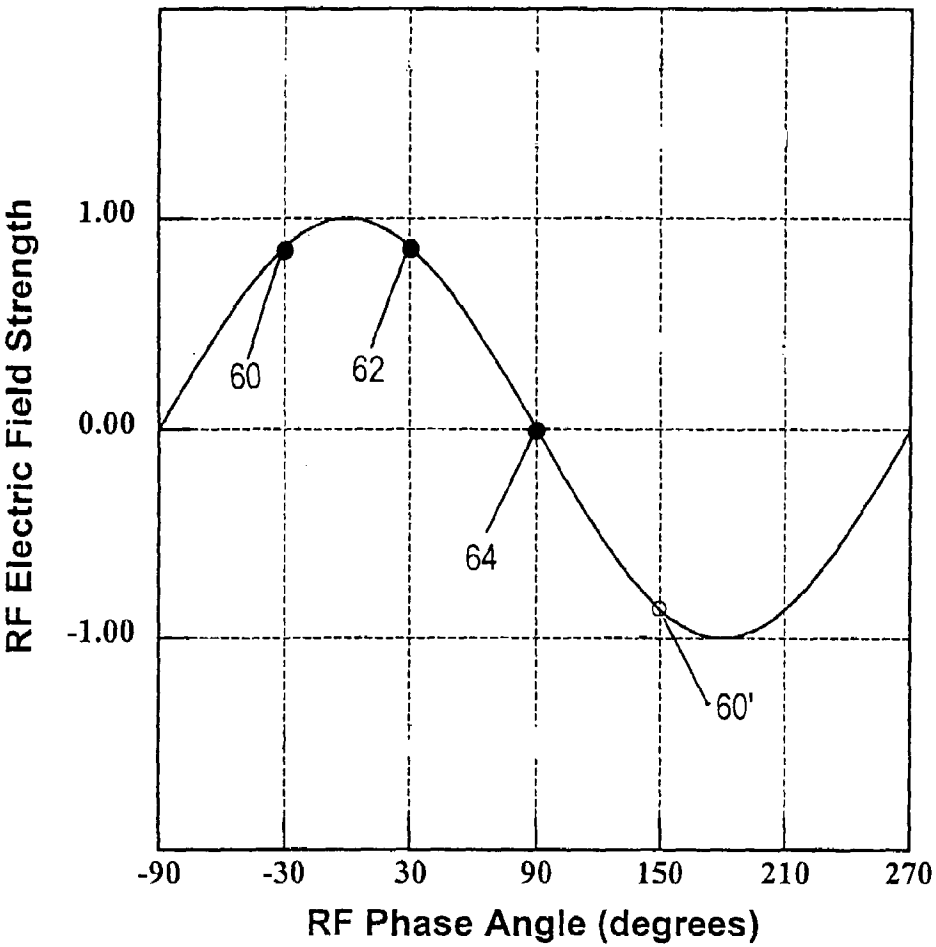
FIG. 7 is a plot of rf electric field strength as a function of rf phase angle showing the acceleration, focusing, and drifting phases as depicted in FIGS. 6, and 8A–8C.
Figure 8A:
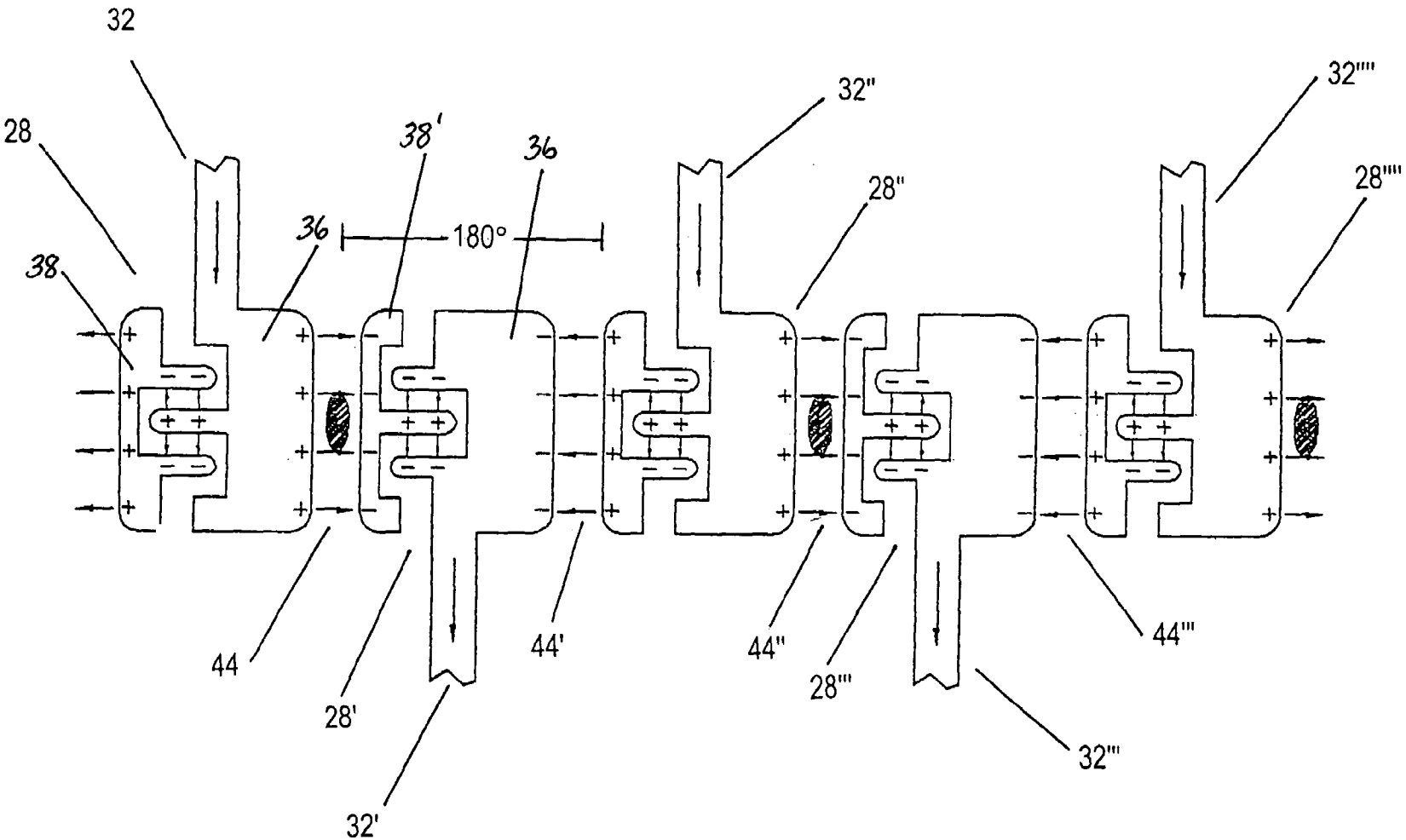
FIG. 8A is a diagram demonstrating the electric current, electric field, electric charge, and particle distribution ("beam bunches") during the acceleration phase of the RFI linac.
Figure 8B:
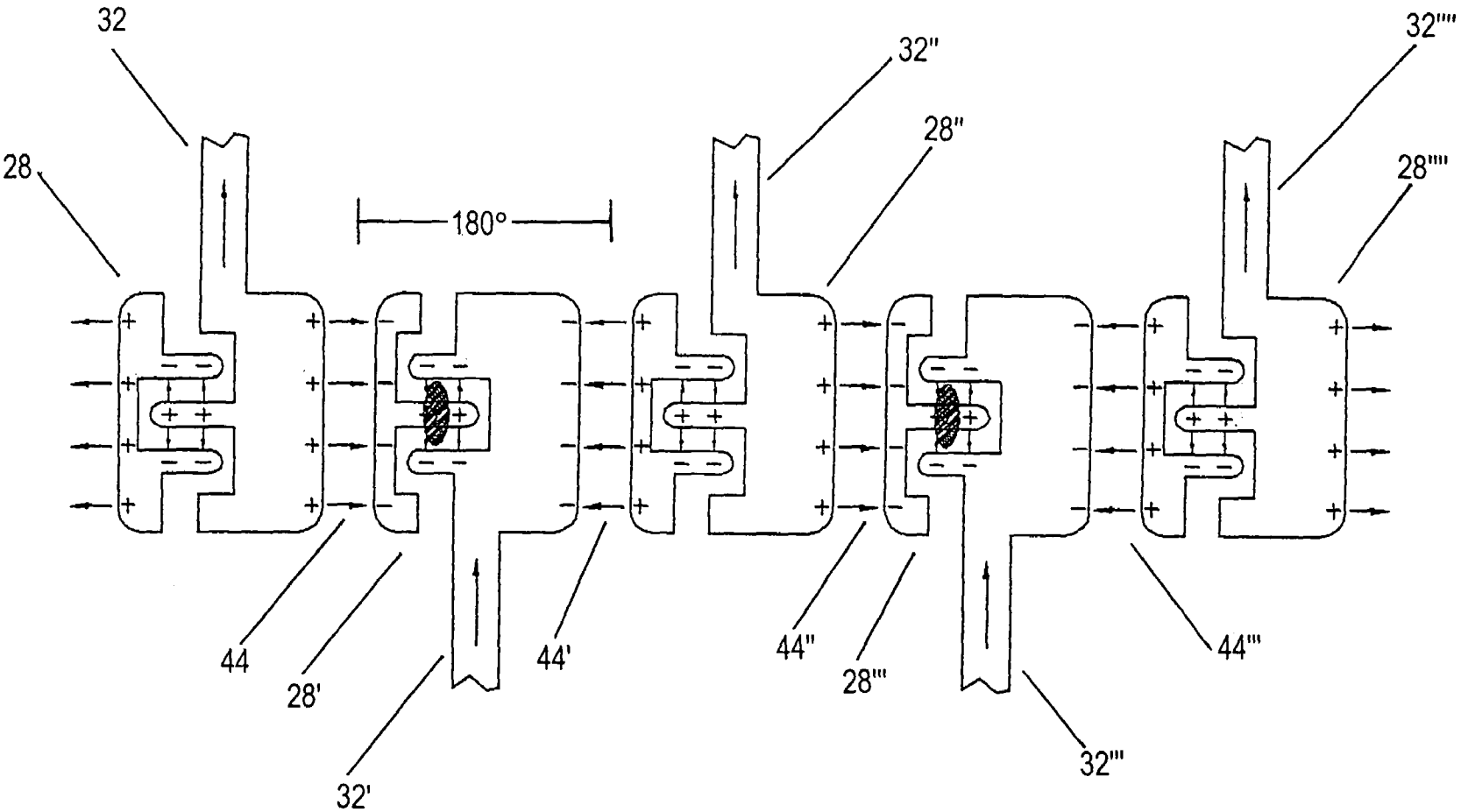
FIG. 8B is a diagram demonstrating the electric current, electric field, electric charge, and particle distribution ("beam bunches") during the focusing phase of the RFI linac.
Figure 8C:
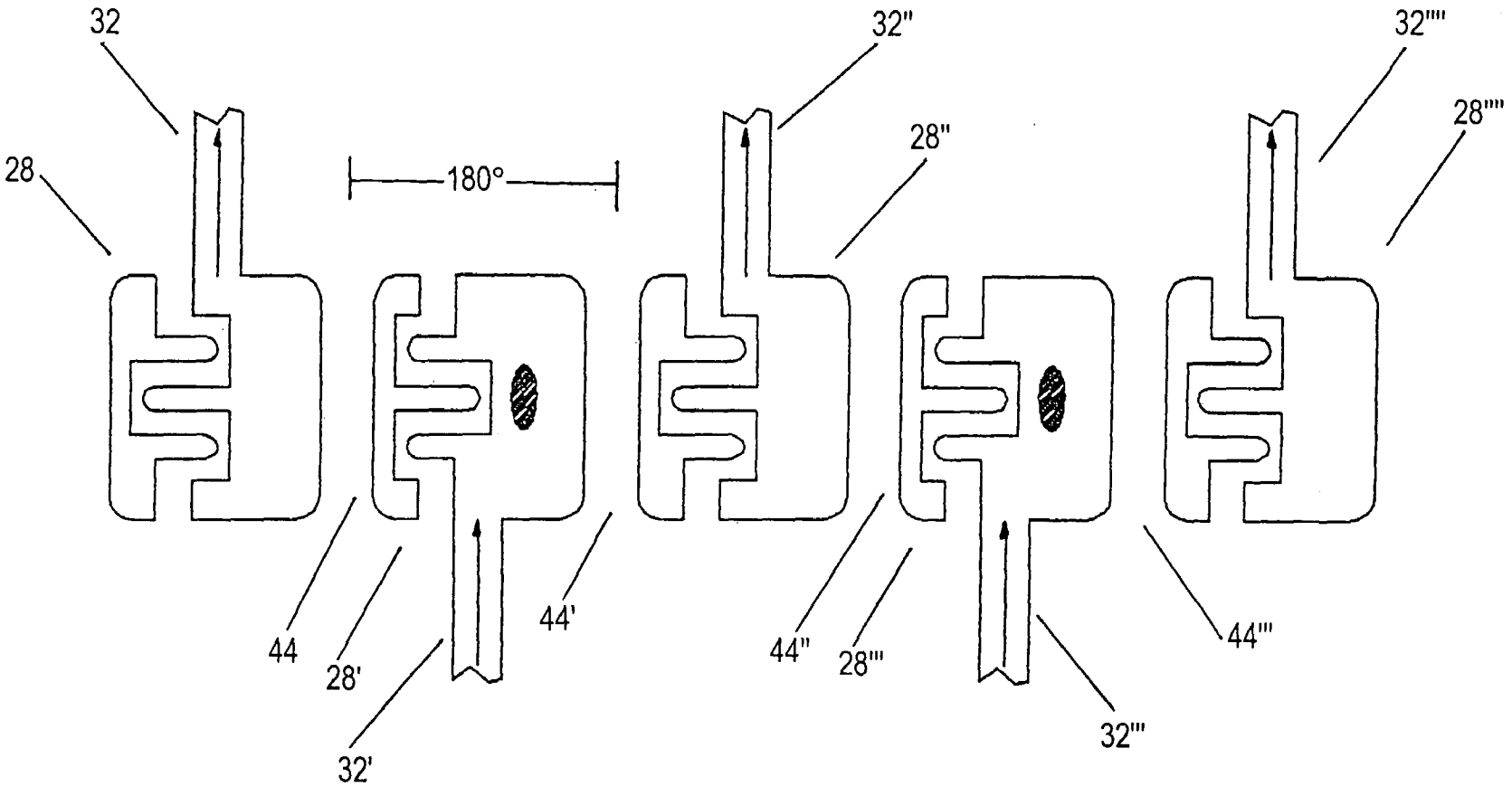
FIG. 8C is a diagram demonstrating the electric current and particle distribution ("beam bunches") during the drifting phase of the RFI linac.

FIG. 7 is a plot of rf electric field strength as a function of rf phase angle, showing the acceleration, focusing and drifting phases of the rf field action on the beam bunches within the RFI linac 10. FIG. 7 shows the accelerating phase at the location designated 60, the focusing phase at the location designated 62, the drifting phase at the location designated 64, and the acceleration phase in the next gap at the location designated 60'. Referring to FIG. 8, the electric current, electric field, electric charge, and particle location ("beam bunches") during the "acceleration phase" (FIG. 8A), "focusing phase" (FIG. 8B), and "drifting phase" (FIG. 8C) of the RFI linac are shown.

Referring to FIG. 8A, five drift tubes 28 of a preferred configuration (N=1, see below) of RFI linac structure 10 are shown with exaggerated finger spacings, where the distribution of electrical currents (large arrows) in major stems 32, electric charges (+ and − signs), and electric fields (small arrows) are shown at the acceleration phase.

The directions, shown for the fields inside drift tubes 28, pertain only to the field components in the plane of the figure. The field components normal to the figure are in the opposite direction relative to the axis of the RFI linac structure 10. The transverse fields vanish on the axis in both transverse planes. By convention, electric fields point from positive charges to negative charges, representing the direction of the force they would exhibit on "positive" beam particles. For the descriptions herein, the beam is assumed to be positive. The same RFI linac structure 10 accommodates acceleration and focusing of "negative" beam particles by simply shifting the phase of all fields by one half cycle.

At the acceleration phase, electrical currents flow towards the drift tubes 28, 28", and 28"" supported from one side of the structure, resulting in a net positive charge on these drift tubes, and away from the drift tubes 28' and 28'" supported from the opposing side of the structure, resulting in a net negative charge on these drift tubes. These net electrical charges result in electric fields in the gaps 44 between the drift tubes pointing from the positive drift tubes to the negative drift tubes.

Shown also in FIG. 8A are the locations of the beam bunches (shaded ellipses) at the acceleration phase, which are assumed to be moving from left to right. The stated field convention indicates that these beam bunches will experience forces in the direction of motion from the electric fields, which will serve to accelerate them. One-half rf cycle (180°) later, the beam bunches have moved to the next gap and the field directions have reversed. Here again, the beam bunches experience forces in the direction of motion from the electric fields, which will accelerate them.

At the acceleration phase, the electric fields in gaps 44 are in the proper direction for acceleration of the beam and are approaching maximum magnitude. Typically the acceleration phase is designed to be 30° in advance of the peak magnitude (see FIG. 7) in order to provide a longitudinal focusing action on the beam to keep it bunched. Associated with this choice of acceleration phase is a weak transverse defocusing action that must be overcome by additional transverse focusing incorporated into the linac structure.

The beam bunches arrive at the centers of the rf quadrupole focusing region within drift tubes 28 one-sixth of an rf cycle later (FIG. 8B) when the electric fields have passed through their peak magnitude and are beginning to decrease in magnitude (See FIG. 7). At this phase, hereinafter referred to as the "focusing phase", the fields within drift tubes 28, when configured as described herein, provide the additional transverse focusing required to keep the beam small enough to stay within the aperture 46 (see FIG. 5A) of drift tubes 28 and interact efficiently with the acceleration fields.

Referring to FIG. 8B, the same five drift tubes 28 of RFI linac structure 10 of FIG. 8A are shown at the focusing phase, one-sixth of an rf cycle (60°) after the acceleration phase. (See FIG. 7) In the focusing phase, the beam bunches have moved inside drift tubes 28 and are centered on the regions of the rf quadrupole focusing fields. In the focusing phase of FIG. 8B, the currents are reversed, while the charges and electric field strength are the same. (See FIG. 7) The directions shown for the electric fields inside the drift tubes pertain only to the component of the rf quadrupole fields in the plane of the figure. The components of these fields normal to the figure are in the opposite direction relative to the axis of the structure. The rf quadrupole fields vanish on the axis in both transverse planes.

Particles, within the beam bunches, traveling along the axis experience no focusing force, as the transverse fields vanish on the axis. Off-axis particles in the plane of the figure in the second and fourth drift tubes (28' and 28'") of FIG. 8B will experience forces directed away from the axis resulting in a "defocusing" action on the beam. One-half of an rf cycle later, after the electric fields have reversed, off-axis particles in the plane of the figure in the first, third and fifth drift tubes ( 28, 28" and 28"") of FIG. 8B will experience forces directed towards the axis resulting in a "focusing" action on the beam. The principle of alternating gradient focusing establishes that a sequence of focusing and defocusing forces can result in a net focusing action.

FIG. 8C shows the same five drift tubes 28 of RFI linac structure 10 of FIG. 8A at the drifting phase, one-sixth of an rf cycle (60°) after the focusing phase (See FIG. 7). In the drifting phase, currents are in the same direction as in the focusing phase, but are now at the maximum, while the charges and electric fields are zero.

Sixty degrees later, the beam bunches will be in the next acceleration gaps, corresponding to the second and fourth gaps of FIG. 8A, where as seen in FIG. 7 for the rf phase angle designated 60', the electric field strength has changed sign, resulting in a reversal of all the currents, fields, and charges shown in FIG. 8A, which implies an accelerating action on the beam bunches in the second and fourth gaps of FIG. 8A at this rf phase.

Major electrode 36 and minor electrode 38 operate at different electrical potentials as determined by the rf fields in the cavity of RFI linac 10. These fields have the property of focusing the beam in one transverse plane while defocusing the beam in the orthogonal transverse plane.

In order to realize a net focusing action in both transverse planes, it is necessary to alternate the orientation of the quadrupole focusing elements (the four-finger geometries) (see e.g., FIGS. 4, 6, and 8) along the axis so as to produce a periodic succession of focusing and defocusing actions in each plane that, under proper conditions, will exhibit net focusing in each transverse plane.

Longitudinal dimensions of linacs are normally described in terms of the distance that the particles travel during one period of the radio frequency, or the "particle wavelength". Particle wavelength is often written symbolically as $\beta\lambda$, where $\beta$ is the particle velocity in units of the velocity of light, and $\lambda$ is the free space wavelength of the radio frequency. The fundamental periodicity of the RFI linac structure is equal to $\beta\lambda/2$ (one-half of the particle wavelength). The particles traverse two distinct regions, namely the gaps between drift tubes 28, where acceleration occurs, and the regions inside drift tubes 28, where rf focusing occurs.

In this alternating configuration of focusing and defocusing actions, the length of the focal period corresponds to two periods of the drift tube spacing. It is useful to define the quantity N to be the ratio of this length to the particle wavelength, $\beta\lambda$. As the preferred drift tube spacing is one half of the particle wavelength, the preferred value of N is 1. Thus for this configuration, the fundamental periodicity of the focusing dynamics (the distance between similar orientations of the four-finger geometries) is equal to the particle wavelength, while the fundamental periodicity of the acceleration dynamics (the distance between acceleration gaps) is equal to one-half of the particle wavelength.

For some applications, there are mechanical and/or beam dynamical reasons to consider drift tube spacings of more than one-half of the particle wavelength and/or focal periods of more than twice the drift tube spacing. Alternate configurations of the RFI linac structure include those with drift tube spacings equal to larger odd integer multiples of one-half of the particle wavelength and/or focal periods corresponding to larger even integer multiples of the drift tube spacing.

For example, the RFI linac 10 also includes embodiments where the focusing periodicity is an integer multiple, greater than unity (N>1), of the particle wavelength to enhance the effective focusing strength, which has been shown to be proportional to $N^2$. This is a practical alternative for the lowest energy portions of RFI linacs, particularly where the particle wavelength is very short.

The RFI linac 10 also includes embodiments where the gap-to-gap distance is an odd integer multiple, greater than unity, of one-half of the particle wavelength, so as to imply longer drift tubes with more internal space for focusing elements. This is also a practical alternative for the lowest energy portions of RFI linacs, particularly where the particle wavelength is very short.

As shown in FIG. 2, the RFI linac structure 10, consisting of a linac tank 22 together with the series of drift tubes 28 along the axis and end plates (not shown), represents a resonant cavity that can be filled with electromagnetic energy to produce high strength electric fields for acceleration of charged particles. Drift tubes 28 and gaps 44 (FIG. 6) between them form a series of capacitors that become charged and discharged by the rf electric currents associated with the designated rf cavity mode, establishing electric fields in gaps 44. The acceleration gaps 44 between drift tubes 28, and four-finger geometries within drift tubes 28 (lenses), form capacitive dividers that place a portion of the rf acceleration voltage on the rf focusing lenses of the structure. In order that the major and minor stems 32 and 34 of each drift tube 28 do not short the rf focusing potential of the rf lenses, the stems are configured as inductive dividers, coupled primarily to the magnetic fields of the interdigital linac, to yield the same potential difference to the rf lenses as the capacitive dividers.

The magnetic fields of the interdigital linac can be divided into two components, as shown in FIG. 4*a*, namely a longitudinal component 66 that runs the length of the linac 10, and a stem component 67 that encircles each major stem 32. Locating the minor stems 34 "upstream" of the major stems 32 couples to the stem component 67 of the interdigital linac magnetic fields. Locating the minor stems 34 "offset to one or both sides" of the major stems 32, as clearly shown in FIGS. 2, 3, and 4A, couples to both the longitudinal 66 and stem 67 components of the interdigital linac magnetic fields. The increased amount of flux captured with the "offset" configuration increases the rf focusing action of the linac.

The "offset" configuration, is shown in FIGS. 2, 3, and 4A, where for mechanical rigidity, the minor stems 34 are shown to be extended symmetrically on both sides of the major stems 32. So configured, the minor stems 34 are essentially radial stems extending from the tank wall to the minor drift tube, offering unlimited coupling (from 0% to nearly 100% of the cell voltage) to the longitudinal 66 and stem 67 components of the interdigital linac rf fields. The coupling is a simple function of the angle, $\theta$, between the radial stem and the major stem—the greater the angle, the greater the coupling. It is noted that while each minor stem 34 is shown extended symmetrically on both sides of the corresponding major stem 32, forming an approximate "V" shape (see FIG. 4A), the RFI linac is not limited to this configuration for minor stem 34. The minor stem 34 can alternatively extend radially offset from one side of major stem 32 and couple to the longitudinal component of the interdigital linac magnetic field.

To facilitate the fabrication of the RFI linac 10 under this radial stem approach, a "stacked cell" approach, shown in FIG. 2, is implemented where the basic unit of the structure is a single cell, complete with a two-piece drift tube 28, supported by major and minor stems 32 and 34 in a short section or ring of the outer wall 24. The RFI linac 10 is assembled by stacking up a sequence of these unit cells 24, each with the proper dimensions. The stack can be held together either by tie-bolts running along the structure or by welding the cells together into a linac tank 22.

Figure 9A:
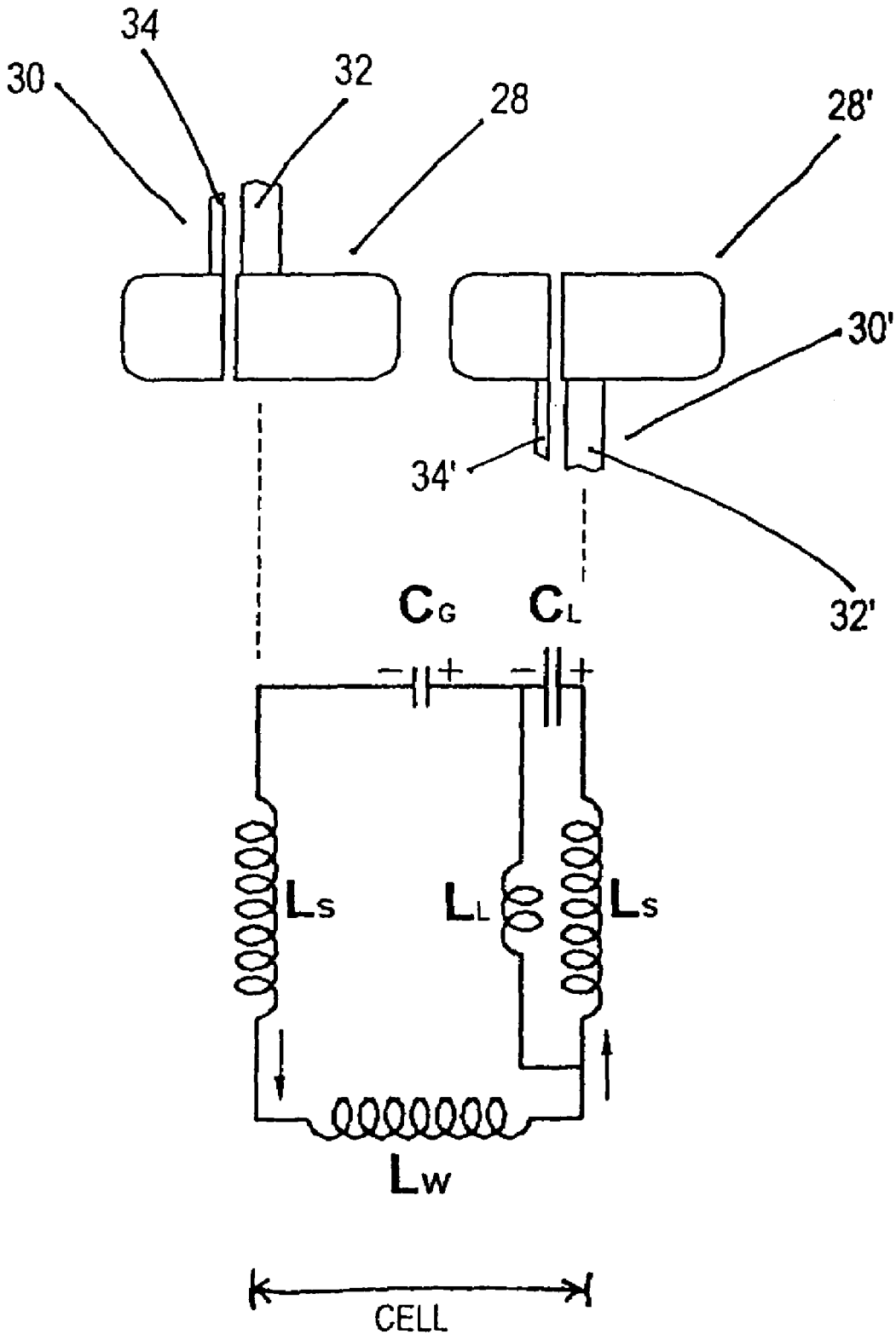
FIG. 9A is an equivalent "LC" tank circuit, consisting of the gap capacitance, $C_G$, and the lens capacitance, $C_L$, in series with two half-stem inductances, $L_S/2$, and the wall inductance, $L_W$; representing a single cell of the RFI linac.

The equivalent electrical circuit for the basic cell of this structure, extending from the center of one drift tube support stem 30 to the center of the next drift tube support stem 30', is shown in FIG. 9A as a simple "LC" tank circuit, consisting of the gap capacitance, $C_G$, and the lens capacitance, $C_L$, in series with two half-stem inductances, $L_S/2$, and the wall inductance, $L_W$. The drift tube portion of the RFI linac structure is shown directly above the equivalent electrical circuit to correlate the electrical circuit elements to the physical elements of the RFI linac structure. The arrows indicate the direction of the positive electrical currents that result in the electrical charge distributions on the capacitors, shown by the + and − signs, ¼ of an rf cycle later. The inductance of minor stem 34', $L_L$, of the two part drift tube couples to the magnetic field of major stem 32' in such a way that there is no net current on the minor stem. There is no change in the net electrical charge on the minor part of the drift tube. The total voltage across the gap and lens capacitances is divided in proportion to the reciprocal of their respective capacitances. As the lens capacitance is significantly larger than the gap capacitance, the majority of the voltage will appear across the gap capacitances for acceleration of particles, while a lesser but adequate portion of the voltage will appear across the lens capacitance for focusing the particles.

The effective capacitance, $C_e$, of the circuit of FIG. 9A is:

$$C_e = \frac{1}{1/C_G + 1/C_L}. \tag{1}$$

The effective inductance, $L_e$, of this circuit is:

$$L_e = L_S \Leftrightarrow L_W. \tag{2}$$

This circuit resonates at a frequency, $f_{res}$:

$$f_{res} \propto \frac{1}{\sqrt{L_e C_e}}. \tag{3}$$

Figure 9B:
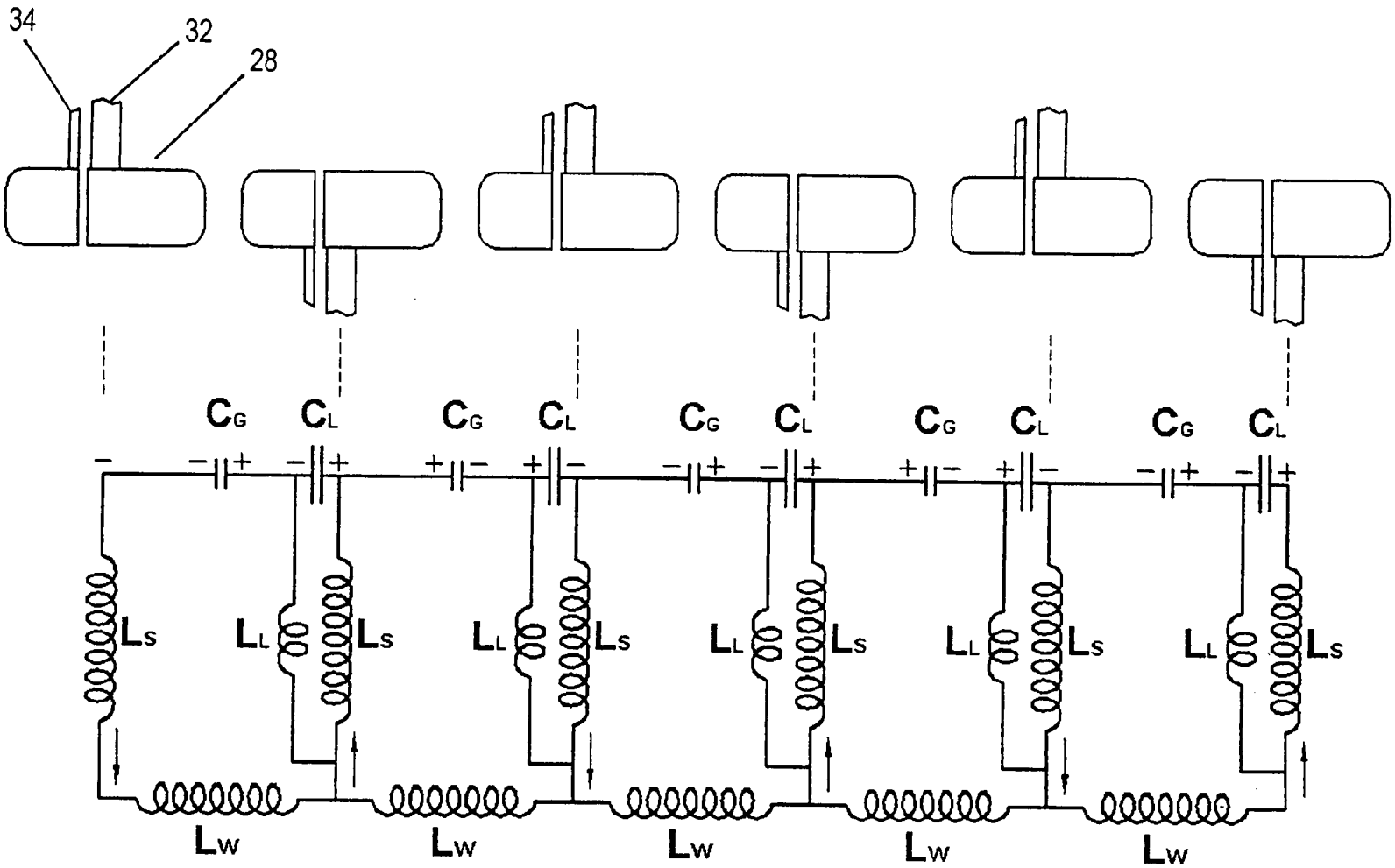
FIG. 9B shows the equivalent electrical circuit for a sequence of five cells of the RFI linac structure.

FIG. 9B shows the equivalent electrical circuit for a sequence of five basic cells of the RFI linac structure 10. The direction of the electrical currents, shown by the arrows, and the polarity of the electrical voltages, shown by the + and − signs, alternate from cell to cell. The polarity of the voltage in every other cell is suitable for acceleration of the beam. The voltage in the other cells will be suitable for acceleration of the beam ½ cycle later after the electrical currents and voltages have reversed.

The equivalent circuit for the conventional interdigital linac is very similar to that shown in FIG. 9A, where the lens capacitance, $C_L$, has been replaced by a short circuit, and the minor stem inductance, $L_L$, is missing to reflect the fact that the drift tubes of the conventional interdigital linac structure are single electrodes supported on single stems.

In any case, the general differential equation describing the particle motion is:

$$\frac{d^2x}{dt^2} + [g + h\cos(\omega t)]x = 0. \tag{4}$$

where g accounts for constant linear forces and h cos(ω t) accounts for the alternating gradient force. By changing to the independent variable n, where $n=\omega t/2\pi=f\,t$, where f is frequency and t is time, the equation can be written as a function of two parameters, $A=g/f^2$ and $B=h/f^2$:

$$\frac{d^2x}{dn^2} + [A + B\cos(2\pi n)]x = 0 \tag{5}$$

The quantity n advances by unity during each period of the focusing structure. This is Mathieu's equation, the general properties of which are well known by those of skill in the art. It is stable for some combinations of A and B, and unstable for others. It is standard practice to map the A-B space, designating the stable and unstable regions and giving some properties of the stable motion within the stable regions.

For A=0, the equation has a range of stability from B=0 to B=17.92, where:

$$B = \frac{dF/dx}{m\left(\frac{f}{N}\right)^2}, \tag{6}$$

where dF/dx is the electromagnetic force gradient, m is the particle mass, f is the frequency of the rf energy, and N is the length of the focal period divided by the particle wavelength, βλ.

For magnetic focusing:

$$\frac{dF}{dx} = q\beta c\left(\frac{dB_y}{dx}\right) \tag{7}$$

and for electric focusing:

$$\frac{dF}{dx} = q\left(\frac{dE_x}{dx}\right) \tag{8}$$

where q is the particle charge, βc is the particle velocity, and $B_y$ and $E_x$ are components of the focusing magnetic and electric fields respectively. The maximum acceptance for A=0 occurs at B=11.39.

In terms of the lens aperture and voltage, the focusing parameter, B, for the RFQ linac structure is given by the unitless quantity:

$$B = \frac{V\lambda^2 N^2}{(M/Q)a^2}, \tag{9}$$

where V is the voltage between the fingers of the quadrupole lens (in volts), λ is the free-space wavelength of the rf (in meters), N (for the conventional RFQ) is unity, M/Q is the mass to charge ratio of the beam particle (in electron-volts), and a is the average radial aperture of the quadrupole lens (in meters).

The focusing parameter, B, for the RFI linac structure is approximately half of that for an RFQ structure of the same frequency, vane-tip voltage and aperture. This is due to only a third of the space being dedicated to focusing at the rf phase where the focusing fields are near maximum. Hence, the focusing parameter for the RFI structure (with N=1) is:

$$B = \frac{V\lambda^2}{2(M/Q)a^2}. \tag{10}$$

For example, consider an 200 MHz RFI linac for proton acceleration with a radial aperture of 2 mm. This structure would require a total voltage on the focusing element of about 22 kV to produce a focusing parameter of about 6.6, which lies well within the stable region of the beam dynamics.

Excessive electric field strengths on metallic surfaces in vacuum lead to electrical breakdown. The limiting field strength, as determined by W. D. Kilpatrick in 1953, are frequency dependent and, in the units of MV/m, are approximately equal to the square root of the frequency in MHz. The Kilpatrick limit for 200 MHz is about 14 MV/m. Modem vacuum and surface cleaning techniques now make it acceptable to exceed Kilpatrick's limit by approximately a factor of 2. The maximum surface electric field on the fingers in this example is:

$$1.4\left(\frac{V}{a}\right) = 15.4\ MV/m \tag{11}$$

for a conservative rating of 1.1 Kilpatrick.

At an average axial electric field strength of 10 MV/m, the cell length for a 2-MeV proton would be about 24 mm long and the voltage across the acceleration gap would be about 240 kV. At a proton energy of 8 MeV, the cell length would be twice as long and the gap voltage would be twice as much, or 480 kV. For these two geometries, the focusing voltages are less than 10% of the gap voltages. Hence, only a small fraction of the linac excitation is used for focusing the beam, while a majority of the excitation is used for acceleration of the beam.

A brief overview of the operation of the RFI linac structure 10 will be given here. This overview is not intended as a rigorous theoretical description of the structure, but rather, as a simple intuitive description. As the acceleration dynamics are very similar to that of the conventional interdigital linac and the focusing dynamics are very similar to that of the conventional RFQ linac, the reader is referred to cited or equivalent references, for a more thorough and theoretical treatment of these dynamics.

The electric fields in the structure alternate in magnitude and direction, in a sinusoidal fashion, going through complete sinusoidal cycles at the resonant frequency of the structure, which in the preferred configuration is hundreds of millions of times per second. (See FIG. 7.) The beam bunches have the same temporal periodicity.

As discussed above, the drift tubes become charged and discharged by rf electrical currents associated with the designated rf cavity mode, thereby establishing electric fields in the gaps between the drift tubes. The drift tubes have apertures allowing passage of a charged particle beam along the axis of the structure. The lengths of the drift tubes and gaps are such that the charged particle bunches travel from the center of one gap to the center of the next gap in exactly an odd integer multiple of half-periods of the rf power, where the preferred value is one-half of the rf period.

The phase of the rf field is adjusted, relative to the incoming bunches, so that the particle bunches arrive at the center of each gap at the proper phase for acceleration. This same adjustment insures that the fields will be near maximum strength and the same polarity when the bunches arrive at the focusing region inside the drift tubes. These fields are used for focusing and defocusing the particle beam bunches.

The electric field distribution of the rf quadrupoles created by the fingers of the drift tubes have the property that they focus the beam in one transverse plane while defocusing the beam in the orthogonal transverse plane.

In a preferred embodiment (N=1), the azimuthal orientation of the fingers in the drift tubes are offset by ±90° from that of their neighboring drift tubes (see FIGS. 6 and 8). This yields a focusing action that alternates from focusing to defocusing in each transverse plane as the beam progresses through the structure, which in turn yields a net focusing action in both transverse planes.

The envelope of the beam is widest in the center of the focusing region and narrowest in the center of the defocusing region. As the focusing action in each drift tube represents a focusing region for one transverse plane and a defocusing action for the orthogonal transverse plane, the beam will be widest in one transverse direction and narrowest in the orthogonal direction. As the beam travels through the structure, its cross-section will alternate between an ellipse with its major axis in one transverse direction, through a circular cross section, to an ellipse with its minor axis in that same direction and then back again. On average, the beam cross section will be circular.

The preferred single-tank, single-frequency aspect of the present RFI linac allows the use of a self-excited rf power system that would eliminate much of the cost and complexity of conventional rf power systems. As it is easy to make an rf amplifier oscillate, some feedback mechanism between the rf power in the linac structure and the input to the power amplifier is sufficient.

If the RFI linac section is powered by a self-excited technique, the rf amplifiers for the RFQ linac (FIG. 1) can obtain drive power from the RFI structure. A simple, resonance-control system, based on temperature control of the linac structures, will keep the relatively broad-band RFQ system in resonance with the narrower-band RFI system. This simple system obviates the need for an accurate frequency source, a low-level rf power amplifier chain, precise resonance control on the linac structure, and all of the associated power supplies and controls.

The RFI linac structure has excellent properties with the changing geometry associated with the acceleration process. As the particle velocity increases, the cell length increases and the acceleration gap capacitance decreases. If the intra-electrode capacitance of the drift tube body (and the focusing fingers) is approximately constant, regardless of the drift tube length, the focusing voltage remains approximately constant while the acceleration voltage increases with particle velocity. This implies a constant beam diameter throughout the structure.

Because the transverse focusing in the RFI linac structure is electric and similar to that in conventional RFQ structures, the beams in the RFI will have the same small diameter as in conventional RFQ structures. Consequentially, matching the beam from an RFQ into the RFI linac is relatively simple. It is well established that the small diameter beams found in RFQ linacs preserve beam quality better than larger beams found in magnetically focused DTL linacs.

INDUSTRIAL APPLICABILITY

The RFI linac structure significantly impacts linac designs in at least two areas, improved beam quality and higher rf power efficiency. Electric focusing has long been recognized as the best method of focusing low-energy protons and heavy ions, and the melding of acceleration and electric focusing for these particles promises to be an important achievement in ion accelerators. This in turn can lead to advances in uses for such accelerators.

The RFI linac structure provides an important advance in ion accelerator technology, especially for heavy or radioactive ions. These ions are usually produced with fairly low charge-to-mass ratios and consequently are difficult to accelerate to velocities that allow them to be focused by magnetic fields. Electric focusing by means such as an Einzel lens is only marginally effective, allowing large emittance growth with concomitant beam loss in later stages of acceleration. The RFI structure, with its strong electric focusing, will be able to accept and control heavy ion beams at considerably lower energy than has heretofore been possible with low frequency, magnetically focused accelerators. This will allow the acceleration of smaller, low-emittance, more intense beams, making heavy ion accelerators more attractive for many uses.

Another advantage to ion accelerator technology is provided by the high $ZT^2$ (discussed below) that has been found in preliminary three-dimensional rf field calculations. This effect seems to result from the concentration of electric fields in the accelerating gap to a greater extent than in other accelerator structures. Fields elsewhere in the RFI structure are very much lower, producing field energies and electric currents on conducting surfaces that are smaller than other structures. Consequently, ohmic losses are smaller for equivalent acceleration fields, and efficiency is higher. These calculations support the conclusion that it is possible to build ion accelerators operating at low frequencies that would be significantly more efficient than present-day designs, use significantly less rf power, and offer the possibility of continuous (cw) operation. In some cases, it might be more practical to use an RFI linac 10 at room temperature than to build a superconducting linac with its associated cryostats (thermal insulation) and refrigeration systems, and its requirement for electromagnetic focusing magnets external to the cryostats.

The capability to accelerate heavy ions in a more intense, lower emittance beam than is presently available will contribute to research capabilities. Many heavy ion or radioactive beam experiments are hampered by low count rates due to poor transmission of the beam accelerating structures. The RFI linac's superior ability to focus and accelerate these beams provides researchers greater flexibility and latitude in designing experiments, and results in enhanced precision and/or shorter counting times. Some experiments, not practical at the present juncture, might become attractive with improved beams. Similarly, some industries that use rf heavy ion accelerators might significantly increase productivity if the beams in use were better controlled and more intense. It is possible that, as in the case of researchers, some presently impractical industrial methods and technologies may become feasible with the improved beams of the RFI linac structure.

Specifically, the RFI linac may offer improved capabilities to capture and accelerate low energy radioactive isotopes in future Rare Isotope Acceleration (RIA) facilities, and may also find a role in a future Muon Accelerator. The RFI linac has capabilities to accommodate very low velocities (0.001 to 0.01 times the velocity of light) and very low charge-to-mass ratios (1/30 to 1/240). Preliminary calculations suggest that the structure has a very high efficiency (quality factor or Q). The RFI linac also has application in such areas as devices for isotope production and epithermal neutron beam production in the medical field, devices for ion implantation in the semiconductor industry, devices for neutron radiography of aircraft wings and jet engines and portable devices for land mine detection in military applications, and devices for luggage inspection and contraband detection in the security field.

The RFI linac structure (see FIG. 2) is highly three-dimensional, and requires the use of 3D rf field calculational capabilities to optimize its performance. The 3D rf calculational code, SOPRANO, was used for evaluation of the rf field distributions and the rf efficiencies within the RFI linac structure. The rf field distribution was determined within the structure, the cavity mode spectra in the vicinity of the operating mode, the stability of the rf field distribution, the group velocity of energy flow within the structure, the rf efficiency of the structure (the shunt impedance), the acceleration efficiency of the structure (the transit time factor), and the strength of the focusing action.

These calculations show that the optimum cell diameter increases with cell length. As the cell lengths increase to accommodate the acceleration process, the cell diameters must also increase. The varying cross-sectional dimensions of the linac result in a selected distribution of electromagnetic energy within the linac cavity.

Figure 10:
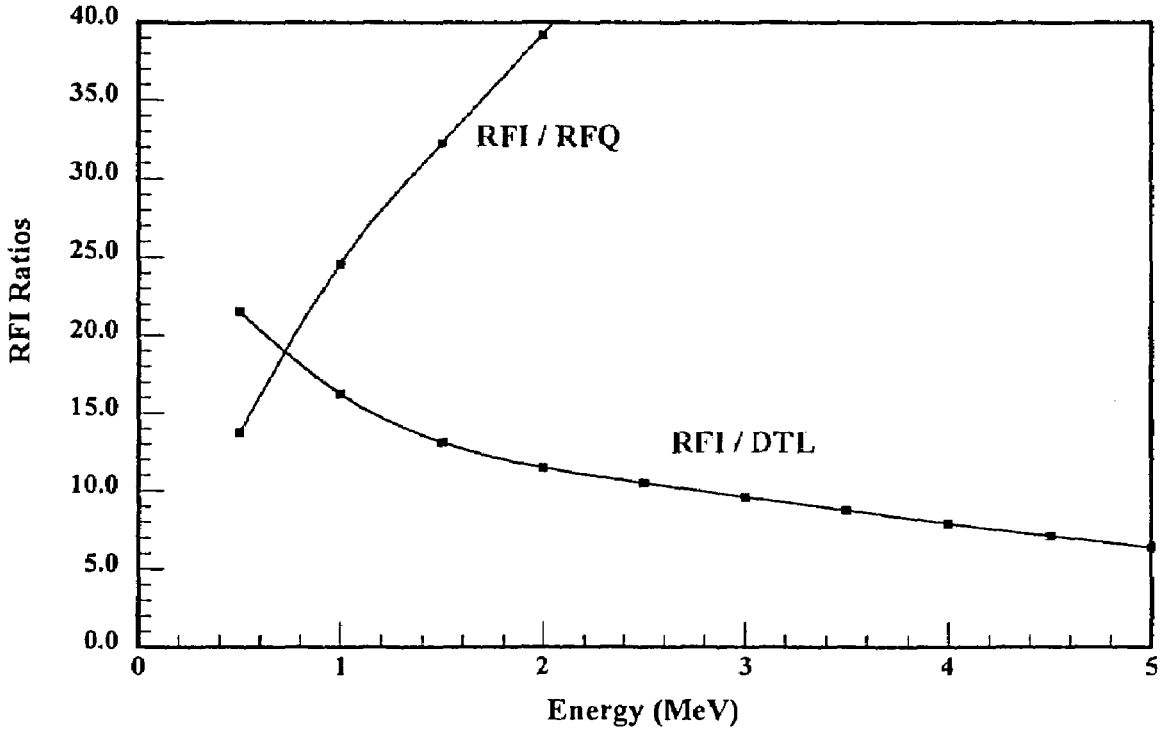
FIG. 10 shows the ratio of the effective shunt impedance of the RFI linac structure to both the RFQ and DTL linac structures as a function of energy.

The principal "figure of merit" for the acceleration efficiency of linac structures is the "effective shunt impedance", which is the product of the rf shunt impedance, Z, times the square of the transit time factor, T. Calculations indicate that the effective shunt impedance, $ZT^2$, for the RFI linac structure is as much as ten times higher than the effective shunt impedance of the conventional drift tube linac structure. Referring to FIG. 10, the ratios of the effective shunt impedance of the RFI linac structure to both the RFQ and DTL linac structures as a function of energy are shown. This represents significant improvements over the prior art.

EXAMPLE

An example of a small RFI linac of N=1 configuration is presented in Tables I and II. This compact proton linac, with a total of 32 cells and a diameter of 0.40 meters, accelerates a 3 millimeter diameter proton beam from 0.75 to 10 MeV in a length of only 2.22 meters. It operates at 200 MHz and has an average axial electric field of 5 million volts/meter. The estimated rf power required to excite the structure is 0.25 megawatt. The basic parameters for this "example" linac are presented in Table I. Table II lists some of the linac parameters as a function of cell number.

TABLE I

| | | |
|---|---|---|
| Accelerated Particle | Proton | — |
| Injection Energy | 0.75 | MeV |
| Final Energy | 10 | MeV |
| Resonant Frequency | 200 | MHz |
| Average Axial Electric Field | 5 | MV/m |
| Number of Cells | 32 | — |
| Length | 2.22 | m |
| Diameter | 0.4 | m |
| Beam Current (peak) | 20 | mA |
| Beam Radius | 1.2 | mm |
| Bunch Length | 5 | degrees |
| Rf Power, Cavity (peak) | 250 | kW |
| Rf Power, Beam (peak) | 200 | kW |
| Rf Power, Total (peak) | 450 | kW |

TABLE II

| Cell Number | Beam Energy (MeV) | Drift tube Length (mm) | Gap Voltage (kV) | Lens Voltage (kV) | Total Length (m) |
|---|---|---|---|---|---|
| Initial | 0.75 | — | — | — | 0.00 |
| 1 | 0.88 | 23.4 | 156 | 62.5 | 0.03 |
| 2 | 1.02 | 25.3 | 168 | 62.5 | 0.06 |
| 3 | 1.17 | 27.1 | 181 | 62.5 | 0.10 |
| 4 | 1.33 | 29.0 | 193 | 62.5 | 0.14 |
| 5 | 1.50 | 30.9 | 206 | 62.5 | 0.18 |
| 6 | 1.68 | 32.7 | 218 | 62.5 | 0.22 |
| 7 | 1.88 | 34.6 | 231 | 62.5 | 0.27 |
| 8 | 2.08 | 36.4 | 243 | 62.5 | 0.32 |
| 9 | 2.29 | 38.3 | 255 | 62.5 | 0.37 |
| 10 | 2.51 | 40.2 | 268 | 62.5 | 0.42 |
| 11 | 2.75 | 42.0 | 280 | 62.5 | 0.48 |
| 12 | 2.99 | 43.9 | 292 | 62.5 | 0.54 |
| 13 | 3.24 | 45.7 | 305 | 62.5 | 0.60 |
| 14 | 3.51 | 47.6 | 317 | 62.5 | 0.66 |
| 15 | 3.78 | 49.4 | 329 | 62.5 | 0.73 |
| 16 | 4.07 | 51.3 | 342 | 62.5 | 0.80 |
| 17 | 4.36 | 53.1 | 354 | 62.5 | 0.87 |
| 18 | 4.66 | 55.0 | 366 | 62.5 | 0.94 |
| 19 | 4.98 | 56.8 | 379 | 62.5 | 1.02 |
| 20 | 5.30 | 58.6 | 391 | 62.5 | 1.10 |
| 21 | 5.64 | 60.5 | 403 | 62.5 | 1.18 |
| 22 | 5.99 | 62.3 | 415 | 62.5 | 1.26 |
| 23 | 6.34 | 64.2 | 428 | 62.5 | 1.34 |
| 24 | 6.71 | 66.0 | 440 | 62.5 | 1.43 |
| 25 | 7.08 | 67.8 | 452 | 62.5 | 1.52 |
| 26 | 7.47 | 69.6 | 464 | 62.5 | 1.62 |
| 27 | 7.87 | 71.5 | 476 | 62.5 | 1.71 |
| 28 | 8.27 | 73.3 | 489 | 62.5 | 1.81 |
| 29 | 8.69 | 75.1 | 501 | 62.5 | 1.91 |
| 30 | 9.12 | 76.9 | 513 | 62.5 | 2.01 |
| 31 | 9.55 | 78.8 | 525 | 62.5 | 2.12 |
| 32 | 10.00 | 80.6 | 537 | 62.5 | 2.22 |

Figure 11A:
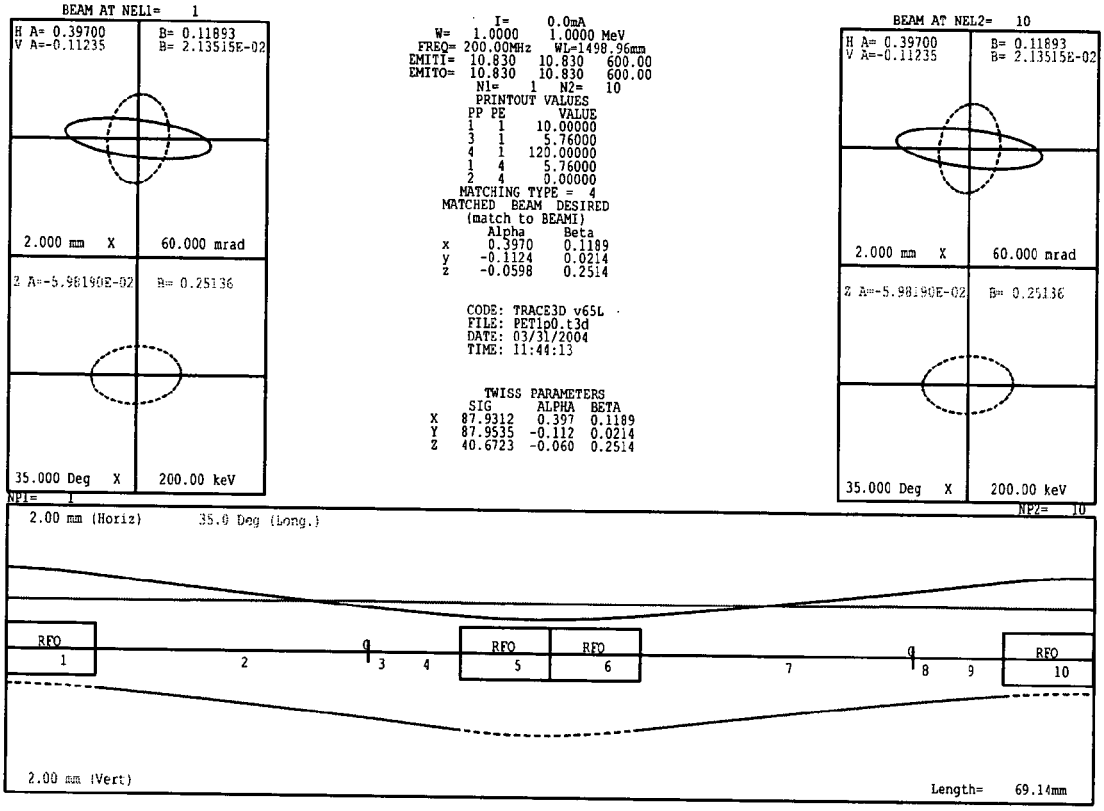
FIG. 11A is the result of a TRACE3D calculation simulation for one full focusing period of a 200 MHz RFI linac for 1 MeV protons.
Figure 11B:
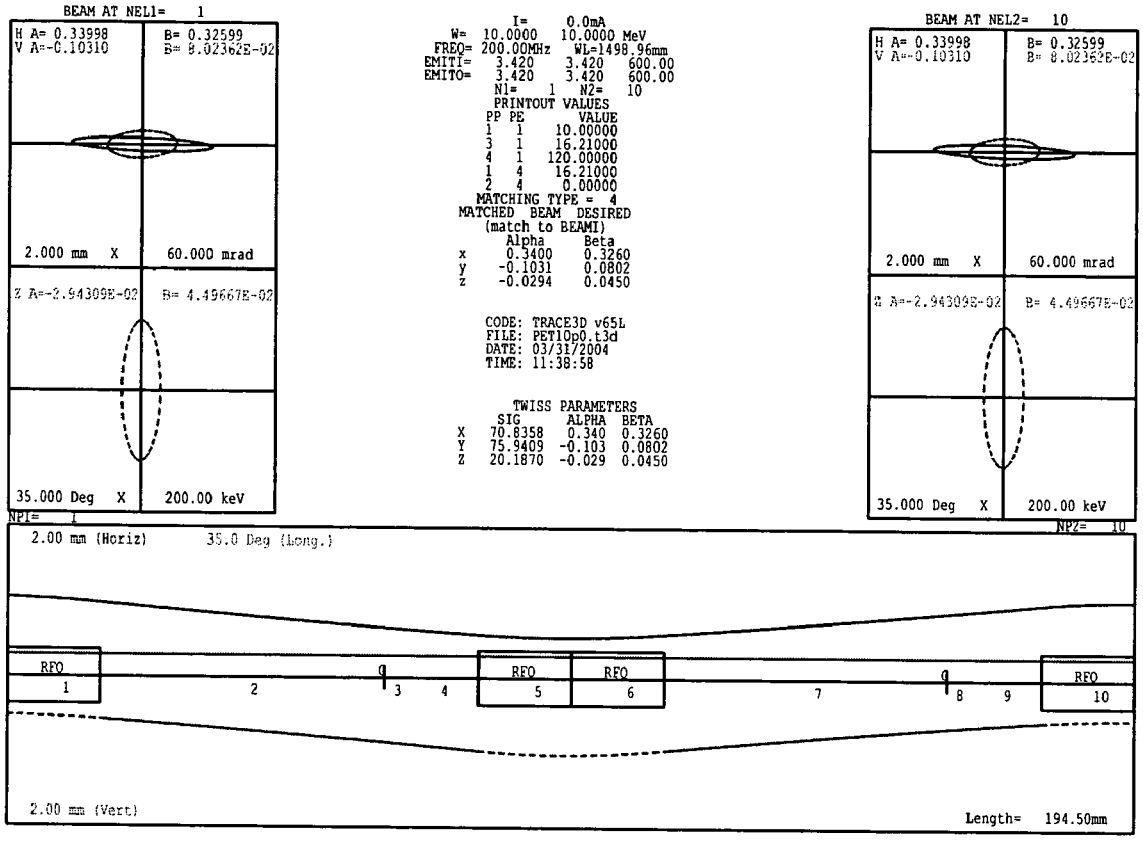
FIG. 11B is the result of a TRACE3D calculation simulation for one full focusing period of a 200 MHz RFI linac for 16 MeV protons.

The beam dynamics performance of the RFI linac structure was investigated with the aid of TRACE3D, a linear beam dynamics computer program. The effect of the rf acceleration and focusing fields in the RFI linac structure on low intensity beams of charged particle beams passing through the structure were analyzed. Results of these studies are shown in FIG. 11. FIG. 11A shows some properties of the "matched beam" through one full focusing period of a 200 MHz RFI linac for 1 MeV protons. FIG. 11B shows some properties of the "matched beam" through one full focusing period of the same linac at an energy of 10 MeV.

Referring to FIG. 11A, the upper graph represents two full cells (one full focusing period) of a 200-MHz RFI linac structure for 1-MeV protons. The two ellipses at the top of this graph represent the transverse phase space (x,x' and y,y') and the single ellipse beneath represents the longitudinal phase space ($\phi$, W) of the matched beam in this full period of the structure. Referring to FIG. 11B, the upper and lower graphs presents similar results for one full period of a 200-MHz RFI linac structure for 10-MeV protons. These calculations establish the capabilities of the RFI linac structure for acceleration of low intensity beams of protons, deuterons, and heavier ions.

At higher intensities, the repulsive electric forces between the charged particles of the beam have a defocusing effect on the beam, tending to reduce the net focusing action provided by the RFI acceleration and focusing fields. The beam current at which this effect jeopardizes the useful performance of the linac structure is referred to as the "space charge limit". The most restrictive space charge limit occurs at the very beginning of the linac where the beam energy is the lowest. The space charge limit of the RFI linac structure was investigated, using the TRACE-3D program, for all combinations of two operating frequencies (100 and 200 MHz) and three injection energies (0.5, 1.0, and 2.0 MeV). In all of these cases, the space charge limits were in excess of 60 mA. At 200 MHz, the space charge limits were in excess of 100 mA. These calculations establish the capabilities of the RFI linac structure for acceleration of high intensity beams of protons, deuterons, and heavier ions.

Although the invention has been described in detail with particular reference to these preferred embodiments, other embodiments can achieve the same results. Variations and modifications of the RFI linac will be obvious to those skilled in the art and it is intended to cover in the appended claims all such modifications and equivalents. The entire disclosures of all references, applications, patents, and publications cited above are hereby incorporated by reference.

What is claimed is:

1. An electrode and support configuration, which when deployed as a drift tube in an interdigital linear accelerator, extracts energy from interdigital linear accelerator rf fields and creates an rf quadrupole field inside said electrode configuration that can focus and defocus a charged particle beam, wherein said support configuration couples to both a stem component of the interdigital linear accelerator rf fields and a longitudinal component of the interdigital linear accelerator rf fields.

2. The invention of claim 1 wherein said drift tube comprises:

at least two electrodes from said electrode configuration creating the rf quadrupole field inside said drift tube.

3. The invention of claim 1 wherein said electrode is excitable by the rf fields in a $TE_{110}$-like rf cavity mode of the interdigital linear accelerator.

4. The invention of claim 1 wherein said rf quadrupole field focuses charged particles in a first plane and defocuses charged particles in a second plane normal to said first plane.

5. The invention of claim 2 wherein said at least two electrodes comprises:

a major electrode; and a minor electrode.

6. The invention of claim 5 wherein said electrode support configuration comprises:

a major support stem from said stem component supporting said major electrode; and a minor support stem from said stem component supporting said minor electrode.

7. The invention of claim 6 wherein said major and minor support stems are configured as inductive dividers, coupled to the rf fields of the interdigital linear accelerator, to effect the potential differences of said major and minor electrodes.

8. The invention of claim 5 wherein said major electrode is excitable to a first potential and said minor electrode is excitable to a second potential by the rf energy within the interdigital linear accelerator.

9. The invention of claim 5 wherein said minor electrode is located upstream of said major electrode.

10. The invention of claim 5 wherein said major electrode comprises two fingers lying in a first plane and wherein said minor electrode comprises two fingers lying in a second plane substantially perpendicular to the first plane, said major electrode fingers and said minor electrode fingers comprising a four-finger geometry, said four-finger geometry producing said rf quadrupole field.

11. The invention of claim 5 wherein said major electrode is larger than said minor electrode to account for a 60 degree phase shift from an accelerating phase to a focusing phase and to account for a 120 degree phase shift from a focusing phase to an accelerating phase in the interdigital accelerator.

12. The invention of claim 1 wherein said interdigital linear accelerator comprises a radio frequency focused (RFI) interdigital linac for accelerating charged particles, said focused interdigital (RFI) linac comprising:

an rf resonance cavity; and a plurality of drift tubes positioned in an interdigital array within said rf resonance cavity, each of said drift tubes comprising a specific rf quadrupole field, each of said drift tubes supported by the support configuration coupled to both the stem component and the longitudinal component of said interdigital linear accelerator rf fields.

13. The invention of of claim 12 wherein said interdigital linear accelerator's rf resonance cavity is excited in the $TE_{110}$-like rf cavity mode.

14. The invention of of claim 12 wherein said interdigital linear accelerator comprises the positioning of said drift tubes and the strength and orientation of said rf quadrupole fields are appropriate for acceleration of light ions.

15. The invention of The of claim 14 wherein said interdigital linear accelerator comprises light ions comprises ions selected from the group consisting of protons and deuterons.

16. The invention of claim 12 wherein said interdigital linear accelerator comprises the positioning of said drift tubes and the strength and orientation of said rf focusing fields are appropriate for the acceleration of heavy ions.

17. The invention of claim 12 wherein said rf resonance cavity of said interdigital linear accelerator comprises varying cross-sectional dimensions resulting in a selected distribution of electromagnetic energy within said cavity.

18. The invention of claim 12 wherein said interdigital array of drift tubes of said interdigital linear accelerator further comprise gaps between said drift tubes, said gaps excited by rf energy within said cavity to accelerate charged particles.

19. The invention of claim 18 wherein said gaps are spaced apart within said cavity by odd integer multiples of one-half of a particle wavelength.

20. The invention of claim 18 wherein said gaps comprise rf electric fields, at least one of said electric fields alternating in direction from at least one other of said electric fields.

21. The invention of claim 20 wherein a selected one of said Rf electric fields alternates in direction from an adjacent one of said electric fields.

22. The invention of claim 12 wherein said interdigital linear accelerator comprises a selected set of said rf quadrupole fields focuses charged particles in a first plane and defocuses charged particles in a second plane normal to said first plane, and a remaining set of the rf quadrupole fields defocuses the charged particles in said first plane and focuses the charged particles in said second plane.

23. The invention of claim 22 wherein said selected sets of rf quadrupole fields form a periodic distribution wherein a focal period is an integer multiple of the particle wavelength.

24. The invention of of claim 12 wherein each of said drift tubes comprises at least two electrodes.

25. The invention of of claim 24 wherein said at least two electrodes comprises a major electrode and a minor electrode.

26. The invention of claim 25 wherein said major electrode is larger than said minor electrode to account for a 60 degree phase shift from an accelerating phase to a focusing phase and to account for a 120 degree phase shift from a focusing phase to an accelerating phase in said linac.

27. The invention of claim 25 wherein said support configuration comprises a support stem for said major electrode and a support stem for said minor electrode.

28. The invention of claim 25 wherein said major and minor support stems are configured as inductive dividers, coupled to the rf fields of the interdigital linac, to effect the potential differences of said major and minor electrodes.

29. The invention of claim 25 wherein said major electrode is excited to a first potential and said minor electrode is excited to a second potential by the rf energy within said if resonance cavity.

30. The invention of claim 25 wherein said minor electrode is located upstream of said major electrode.

31. The invention of claim 25 wherein said major electrode comprises two fingers lying in a first plane, and wherein said minor electrode comprises two fingers lying in a second plane substantially perpendicular to said first plane, said major electrode fingers and said minor electrode fingers comprising a four-finger geometry, said four-finger geometry producing said rf guadrupole field.

32. The invention of claim 31 wherein the orientation of said rf quadrupole field differs among said plurality of drift tubes.

33. The invention of claim 32 wherein said rf quadrupole field in a selected drift tube is axially rotated 90° from the rf quadrupole field orientation in at least one other of said drift tubes of said interdigital array.

34. The invention of claim 33 wherein the fundamental periodicity of said rf quadrupole orientations is substantially an integer multiple of the particle wavelength.

35. The invention of claim 32 wherein the orientation of said quadrupoles in said drift tubes produces a net alternating gradient focusing action on a charged particle beam in two transverse planes.

36. The invention of claim 12 further comprising a multiple-tank linac for accelerating charged particles, said linac comprising a plurality of radio frequency focused interdigital (RFI) linacs, each of said RFI linacs comprising an rf resonance cavity and a plurality of drift tubes positioned in an interdigital array within said rf resonance cavity, each of said drift tubes supported by a support configuration coupled to both a stem component and a longitudinal component of said interdigital linear accelerator rf fields, and each of said drift tubes comprising an rf quadrupole field, wherein each of said RFI linacs operates at a frequency=If, where I is an integer and f is a selected frequency, and further comprising a control for the relative phase of the accelerating fields of each of said RFI linacs.

37. The invention of claim 12 further comprising a multiple-tank linac for accelerating charged particles, said multi-tank linac comprising:

at least one radio frequency focused interdigital (RFI) linac, said RFI linac comprising an rf resonance cavity and a plurality of drift tubes positioned in an interdigital array within said rf resonance cavity, each of said drift tubes supported by a support configuration coupled to both a stem component and a longitudinal component of said interdigital linear accelerator rf fields, and each of said drift tubes comprising an rf quadrupole field; and, CCL, RFQ, RFD, and superconducting linacs, wherein each of said RFI and other linacs operates at a frequency=If, where I is an integer and f is a selected frequency, and further comprising a control for the relative phase of the accelerating fields of each of said RFI and other linacs.

* * * * *